US006045686A

United States Patent [19]

Fenton et al.

[11] Patent Number: 6,045,686

[45] Date of Patent: Apr. 4, 2000

[54] METHOD AND APPARATUS FOR ELECTROCHEMICAL DELACQUERING AND DETINNING

[75] Inventors: James M. Fenton, Tolland; John E. Dresty, Jr., South Glastonbury; Richard Bodensteiner, North Haven; Chunzhi He, Storrs; Ramakrishnan Venkataraman, Mansfield Center; Jung-Chou Lin, Storrs, all of Conn.; Antonio J. Aldykiewicz, Jr., Brookline, Mass.

[73] Assignee: The University of Connecticut, Storrs, Conn.

[21] Appl. No.: 08/991,029

[22] Filed: Dec. 15, 1997

Related U.S. Application Data

[60] Provisional application No. 60/040,814, Mar. 18, 1997.

[51] Int. Cl.[7] ..... C25F 1/04; C25F 1/06

[52] U.S. Cl. ..... 205/705; 205/712; 205/717; 205/719; 205/741; 205/722; 204/267; 204/269

[58] Field of Search ..... 205/705, 712, 205/717, 719, 741, 722; 204/267, 269

[56] References Cited

U.S. PATENT DOCUMENTS

| | | | |
|---|---|---|---|
| 3,615,357 | 10/1971 | Walner . | |
| 3,660,077 | 5/1972 | Ruf . | |
| 3,886,129 | 5/1975 | Kurz et al. . | |
| 3,925,171 | 12/1975 | Jargon et al. . | |
| 3,969,328 | 7/1976 | Kurz et al. . | |
| 4,004,956 | 1/1977 | Brindisi, Jr. . | |
| 4,056,450 | 11/1977 | McCauslan et al. . | |
| 4,164,542 | 8/1979 | Deren . | |
| 4,219,390 | 8/1980 | Stuart et al. . | |
| 4,226,755 | 10/1980 | Knecht . | |
| 4,227,922 | 10/1980 | Laws et al. . | |
| 4,264,419 | 4/1981 | Pryor . | |
| 4,317,800 | 3/1982 | Sloterdijk et al. . | |
| 4,330,377 | 5/1982 | Franks, Jr. . | |
| 4,474,655 | 10/1984 | Giezen . | |
| 4,544,463 | 10/1985 | Pryor . | |
| 4,678,552 | 7/1987 | Chen | 205/719 |
| 4,988,044 | 1/1991 | Weitzman et al. . | |
| 5,002,232 | 3/1991 | Cutler . | |
| 5,035,749 | 7/1991 | Haruta et al. . | |
| 5,227,036 | 7/1993 | Gordon . | |
| 5,468,291 | 11/1995 | Waterson et al. . | |
| 5,810,995 | 9/1998 | Soilleux et al. | 205/702 |

FOREIGN PATENT DOCUMENTS

| | | | |
|---|---|---|---|
| 659141 | 3/1963 | Canada | 205/719 |
| 53-7504 | 1/1978 | Japan | 205/702 |
| 1 594 251 | 7/1981 | United Kingdom . | |
| 1 594 253 | 7/1981 | United Kingdom . | |

*Primary Examiner*—Arun S. Phasge
*Attorney, Agent, or Firm*—Cantor Colburn LLP

[57] ABSTRACT

A process for the delacquering and detinning of a metal substrate is presented comprising the fully electrochemical removal of both an outer polymeric coating and an inner tin coating from a metal substrate. The disclosed method provides a clean metal substrate, and results in wastes which are easily disposed of with minimal cost and minimal environmental impact. In one embodiment, the present invention comprises a one-stage process for removing an outer polymeric coating and an inner tin coating from a metal substrate in a single electrolyte bath through electrolytic removal of both the polymeric and tin layers from the metal substrate. An electrically conductive container having the electrolyte bath therein acts as an anode in the process, and the removed tin is plated out on the cathode. In another embodiment, the present invention comprises a two-stage process for removing an outer polymeric coating and an inner tin coating from a metal substrate. The first stage comprises removal of the polymeric coating in a first electrolyte bath through application of a cathodic current to a first electrically conductive container, e.g. tank, drum, or the like. The polymeric and tin coated metal substrate that is immersed in the first electrolyte bath is cathodically protected provided the coated metal substrate is in contact with the first electrically conductive container. The second stage comprises removal of the tin coating via application of moderate anodic currents to a second electrically conductive container, e.g. tank, drum, or the like. Such current results in the selective removal of tin from the substrate metal. The second electrically conductive container and the tin cans act as an anode in the process, and the removed tin is plated out on the cathode.

58 Claims, 20 Drawing Sheets

FROM FIG. 1
316
322
326
330
324
328
334
332
318
320
336
337
338
339
342
340
344
346
TO FIG. 3

METHOD AND APPARATUS FOR ELECTROCHEMICAL DELACQUERING AND DETINNING

CROSS REFERENCE TO RELATED APPLICATION

This application claims the benefit of U.S. Provisional Application No. 60/040,814 filed Mar. 18, 1997.

BACKGROUND OF THE INVENTION

1. Field of the Invention

This invention relates to a method and apparatus for removal of outer polymeric coatings and inner tin coatings from metal surfaces. In particular, this invention discloses a method and apparatus for electrochemical removal of both an outer polymeric coating and an inner tin coating from a metal substrate. The invention finds utility in recycling post-consumer tin cans without generation of environmentally hazardous waste.

2. Brief Description of the Prior Art

Three million gross tons of tin-coated steel cans are produced in the United States per year, primarily as packaging for the food and beverage industry. Continued growth of the market share for tin cans in these industries is expected, as tin cans are convenient, safe, and cost effective. However, continued growth in these markets also leads to concerns regarding disposal and recycling of post-consumer tin cans.

Currently, approximately fifteen percent (four hundred fifty thousand gross tons) of all tin-coated steel cans are recycled. This percentage is expected to increase dramatically over the next five to ten years, due to concerns over landfill space and the necessity to treat incinerator ash containing cans as special waste under present environmental regulations. Unfortunately, these recycled cans may have poor markets due to their low value as raw materials.

This low value arises from the nature of tin-coated steel cans manufactured for the consumer market. Most of these tin-coated steel cans (hereinafter "tin cans") have a thin, electroplated coating of tin on both sides of the can for corrosion resistance. A few types of cans have a tin-free coating of chromium instead of tin, and others may contain small amounts of other metals. Hazardous metals such as lead are not currently used for food and beverage packaging. Lead is however used in cans for non-food packaging. Most tin cans further have a polymer resin coating or enamel (hereinafter "lacquer") on the inside of the tin can. Four major categories of lacquer coatings are in use today in the United States, including oleoresins, epoxy phenolics, vinyls, and polyesters. Approximately eighty-five percent of all post-consumer tin can wastes have lacquer coatings, sixty percent of these being epoxy phenolic-type coatings.

The steel used in the manufacture of tin cans is very high quality "low residual" steel, meaning that it contains minimal impurities. ("Low residual" steel as used herein refers to steel having less than 0.04% Ni, 0.06% Cr, 0.05% Mo, 0.02% As, 0.02% Cu, 0.15% P, 0.12% C, and 0.02% other impurities by weight). This low level of impurities allows the steel to be rolled into thin sheets without tearing. Tin is a highly detrimental contaminant in steel because it causes a condition called "hot shortness", which results in embrittlement and tearing during the steel-working operations. Thus the tin coating on tin cans must be removed in order to render them recyclable as a desirable source of steel, preferably to a level below about 0.06% by weight.

A detinning industry for removal of tin from other metals currently exists in the United States, but it is directed to the detinning of trimmings and scrap from new tin plate manufacture and product manufacture. These sources represent a very clear, consistent, uniform, and homogenous feed material. Accordingly, the emphasis in these plants has been the production of an extremely pure tin, rather than clean steel. The large centralized plants that currently exist are based on economy of scale, and have little tolerance for variation in feed material. Such industry is also unsuited for the recycling of post-consumer waste tin cans, due to high transportation costs, difficulties in effecting mechanical size reduction, and difficulties in removing lacquer coatings and other contaminants arising from labels and food residuals.

Transportation costs are high for recycling post-consumer tin cans in these facilities because of the facilities' central location. Existing methods for preparation and sizing of the tin cans tends to ball the metal up into nuggets that prevent even exposure of the tin surfaces for removal. Tin removal is also complicated by the lack of safe, economical methods for removal of the lacquer coatings. Thus the tin cans that are collected for recycling today are often begrudgingly accepted as-is (with the tin coating) in small quantities and for low prices, or surreptitiously hidden and blended into better grades of steel, or exported as one-time distress shipments to foreign mills.

As more recycling programs are instituted, and as consumer participation increases, it is unlikely that the steel industry will be able to absorb the increasing quantities of post- consumer waste tin cans as currently provided. There is even concern in the industry that increasing levels of these cans in the scrap cycle will lead to a dangerous increase in the tin levels of scrap steel, resulting in a temporary curtailment of all steel recycling in favor of virgin pig iron.

Prior detinning methodology makes use of chemical processes, wherein the tin is chemically stripped from the steel. Such chemical process technologies most commonly use a solution of sodium hydroxide to remove tin from tin plate, and then reclaim the tin from solution by electrolysis. The lacquer compositions commonly used for tin cans resists such treatment, reducing the effectiveness of the process. These processes also result in stripping steel from the cans, which is unrecoverable, and which contaminates the baths with iron precipitates. The chemical baths used for detinning are often highly contaminated, and present waste disposal difficulties in and of themselves.

Chemical detinning methods are disclosed in U.S. Pat. No. 4,164,542 to Deren, which uses a solution of highly concentrated sodium hydroxide and sodium nitrate or nitrite heated to 226° F. to 236° F.; and in U.S. Pat. No. 3,660,077 to Ruf, which uses a solution of soda lye and sodium chlorite. Other chemical methods included those disclosed in DE Patent No. 1546126 assigned to Goldschmidt AG (heating in a caustic solution containing a diethyleneglycolmonoalkylether); GB Patent No. 1594253 assigned to Metal Box Co. Ltd. (heating in a caustic solution containing an anthraquinone and an iron complexing agent); GB Patent No. 1594252 assigned to Metal Box Co. Ltd. (heating in a caustic solution containing an anthraquinone and an oxygenated alcohol as a delacquering agent); and U.S. Pat. No. 5,035,749 to Haruta et al. (using a solution of an aromatic nitro compound and then an inorganic acid solution to remove tin from copper).

Other methods for detinning include vacuum deposition (U.S. Pat. No. 4,227,922 to Laws et al.), and heating copper scrap in the presence of anhydrous hydrogen chloride gas (U.S. Pat. No. 5,035,749), and electrochemical removal. For example, electrochemical removal of a tin layer from copper is described in U.S. Pat. No. 4,264,419 to Pryor. This method requires the presence of a stannous ion complexing agent in order to maintain the tin concentration below about $10^{-4}$ gm-ions/L. U.S. Pat. No. 4,056,450 to McCauslan et al. also discloses an electrochemically-based process for detinning clean tin plate scrap, wherein the scrap is continuously advanced through an electrically anodic rotating perforated drum partially immersed in a caustic solution. The removed tin is plated upon cathodes disposed within the tank.

While suitable for removal of tin from relatively clean surfaces, the above-described methods are not suitable for detinning tin cans, because they do not efficiently remove the lacquer layer. The scrap described in McCauslan et al. has no lacquer coating, no labels, and no food residues to interfere with complete tin removal, and the patent notes that certain samples of heavily lacquered scrap yield treated scrap with unacceptably high levels of remaining tin (col. 5, lines 22–25). Accordingly, the process described in McCauslan et al. is unsuitable for treatment of post-consumer waste tin cans.

A few patents have been directed to the problem of lacquer or other coating removal. U.S. Pat. No. 4,474,655 to Giezen discloses a method of detinning painted tin plate waste, wherein the waste is first compressed into bundles, the bundles are immersed in a caustic bath for about sixteen hours in order to soften the paint, and the tin is then removed electrolytically without actual removal of the paint. However, this method requires long cycles, on the order of twenty-four hours per cycle. Other methods available for removal of polymeric layers from metal substrates also have disadvantages.

For example, chemical removal by oxidation in hot, alkaline solution requires high temperatures (greater than 200° F.) that are difficult and costly to maintain in an industrial setting and which results in premature or unnecessary tin, lead or other metal removal. Highly caustic solutions present further operational difficulties. Incineration and dissolution in organic solvents present regulatory difficulties, requiring either air permitting or disposal of hazardous wastes. Incineration further results in migration of tin and iron to create a stable, unremovable tin-iron alloy throughout the tin layer. Cryogenic processing, which requires cooling to −196° F., followed by mechanical shattering, is not cost-effective. Sonication to remove the outer polymeric coating from tin cans after freezing is described in Belgium Patent No. 852010 assigned to British Steel Corp.

Accordingly, there remains a need for the development of methods and apparatus suitable for smaller, more localized, yet still economical methods for recycling post-consumer tin cans. Such methods must further be environmentally benign, generating a minimum of waste requiring subsequent, specialized disposal methods.

SUMMARY OF THE INVENTION

The above-discussed and other drawbacks and deficiencies of the prior art are overcome or alleviated by the method and apparatus of the present invention, comprising the fully electrochemical removal of both an outer polymeric coating and an inner tin coating from a metal substrate. The disclosed method provides a clean metal substrate, and results in wastes which are easily disposed of with minimal cost and minimal environmental impact.

Accordingly, one embodiment of the present invention comprises a one-stage process for removing an outer polymeric coating and an inner tin coating from a metal substrate in a single electrolyte bath through electrolytic removal of both the polymeric and tin layers from the metal substrate. Preferably, the electrolyte bath comprises a solution of caustic, such as caustic metal hydroxide, in a concentration in the range from about 0.2–5.0 N combined with optional surfactants, defoamers, wetting agents, and neutral salts for improved conductivity. The metal substrate acts as an anode in the process, and the removed tin is plated out on the cathode. This method is particularly suitable for the delacquering and detinning of post-consumer tin can scrap.

Another embodiment of the present invention comprises a two-stage process for removing an outer polymeric coating and an inner tin coating from a metal substrate. The first stage comprises removal of the polymeric coating in a first electrolyte bath through application of a cathodic current to the substrate. The first electrolyte bath may for improved conductivity comprise a neutral detergent and/or inorganic salt such as sodium nitrate or it may comprise a weakly caustic alkaline cleaner, combined with optional surfactants, defoamers, wetting agents, and neutral salts for improved conductivity. A preferred detergent is available under the trade name SP-76 (commercially available from Rem Chemicals, Southington, Conn.) which contains alkaline cleaners, surfactants, defoamers and wetting agents. SP-76 is an alkali mixture comprising a sodium hydroxide solid mixture. A suitable surfactant based neutral cleaner is available under the trade name SP-138, commercially available from Rem Chemicals, Southington, Conn. SP-138 is a disodium triexesilicate pentahydrate mixture. Importantly, the pH of the first electrolyte bath is maintained below about 15 in order to minimize metal dissolution. The second stage comprises removal of the tin coating via application of moderate anodic currents to a second electrolyte bath. Such current results in the selective removal of tin from the metal. The tin cans act as an anode in the process, and the removed tin is plated out on the cathode. Preferably, the second electrolyte bath comprises a solution of caustic, for example, potassium hydroxide in an amount from about 0.2 to about 3.0 N. The temperature of this bath is maintained preferably at about 185° F., and in any event below the boiling point of the bath. This method is also particularly suitable for the delacquering and detinning of post-consumer tin can waste. When used to recycle post-consumer tin can waste, the first stage may be preceded by a washing step wherein the labels and food residues are removed from the bath.

Still another embodiment of the present invention comprises the above-described two-stage process, wherein the preliminary washing stage is combined with the lacquer removal step. Accordingly, the first electrolyte bath preferably comprises a solution comprising at least one near-neutral detergent or a weakly caustic alkaline cleaner combined with optional surfactants, defoamers, wetting agents, and neutral salts for improved conductivity. Application of a cathodic current to the coated metal substrate results in simultaneous washing and delacquering. The second stage comprises removal of the tin coating via application of a moderately anodic current to a second electrically conductive container.

In still another embodiment of the present invention, there is disclosed an apparatus for a two-stage process for removing an outer polymeric coating and an inner tin coating from a metal substrate. The apparatus comprises a first electrically conductive container having a first electrolyte solution therein, the first electrically conductive container being receptive to a cathodic current for the removal of an outer polymeric coating from a tin-coated metal substrate; a second electrically conductive container being receptive to an anodic current for removal of the inner tin coating from the metal substrate, and cathodes disposed therein for plating the removed tin; and a conveyor for delivering the delacquered metal substrates from the first electrically conductive container to the second electrically conductive container. The electrically conductive containers may be in the form of a tank, drum or any other shape that is suitable for the practice of the present invention. Within each electrically conductive container there is a conveyor preferably in the form of an internal helix drum conveyor for continuously advancing the coated metal substrate through the respective container. The tin coated metal substrate is advanced from the first electrically conductive container to the second electrically conductive container also by conveyor means known in the art.

In still another embodiment, where the coated metal substrate comprises post-consumer tin can scrap, the apparatus further preferably comprises a preliminary washing tank having a detergent solution disposed therein; and a conveyor for delivering the rinsed tin cans to the first electrically conductive container. The apparatus further preferably comprises a subsequent rinsing container having water therein for rinsing the delacquered, detinned cans; and a conveyor for conveying the detinned cans to the rinse container. The principal product of such apparatus is a high-quality, clean, low-residual steel suitable for recycling.

In still a further embodiment adapted for recycling of a post-consumer tin can scrap, the apparatus further comprises a slitter for the production of substantially open form pieces of tin can, and a conveyor for delivery of the slit tin cans to the preliminary rinsing tank or the first electrically conductive container. Preferably, the slitter should shred the cans to achieve an open form rather than a closed form. This open form allows the electrolyte solutions of the present invention to flow into areas of exposure for all surfaces, and then to allow the dissolved ions or electrons to diffuse away from the surfaces and connect the circuit with the other electrode. Preferably, the slitted cans have a size that is "3 in. by down" (a term in the scrap industry, indicating 3" as the maximum dimension of 80% of the pieces).

An important feature of the present invention is that it generates minimal waste requiring disposal. Electrochemical lacquer removal results in the formation of chunks of lacquer which may be readily filtered from the electrolyte bath. Accordingly, less sludge is generated. Furthermore, the selective removal and plating of tin from the metal substrate results in other metal impurities such as iron and chromium mostly remaining with the metal substrate, rather than being dissolved into the electrolyte bath. The lead reports to the tin cathode, and not to the sludge. Accordingly, the baths may be readily regenerated, or disposed of without the necessity of being classified as hazardous waste under RCRA (the Resource Conservation and Recovery Act).

The above-discussed features and advantages of the present invention will be appreciated and understood by those of ordinary skill in the art from the following detailed description and drawings:

BRIEF DESCRIPTION OF THE DRAWINGS

Referring now to the drawings wherein the like elements are numbered alike in the several FIGURES.

DETAILED DESCRIPTION OF THE INVENTION

The present invention is directed to a method and apparatus for the removal of an outer polymeric and inner tin coating from metal substrates. An important feature of the present invention is that the waste streams generated by the process are primarily non-hazardous wastes as defined by the 1976 Resource Conservation and Recovery Act (RCRA). Non-hazardous wastes are significantly more economical to dispose of, and have a minimal impact on the environment. Accordingly, the electrolyte baths used in the present invention are designed to be regenerable, and the overall system preferably forms a "closed-loop" process, that is, a process wherein the output streams are reused or recycled.

Accordingly, one embodiment of the present invention comprises a one-stage process for removing an outer polymeric coating and an inner tin coating from a metal substrate in a single electrolyte bath though electrolytic removal of both the polymeric and tin layers from the metal substrate. The coated metal substrate is delivered to the electrolyte bath with or without preliminary processing as required by the particular application.

The electrolyte bath comprises an aqueous solution of at least one electrolyte, including but not limited to, caustics known in the art such as caustic metal hydroxide, e.g. potassium hydroxide. The caustic is present in a concentration in the range from about 0.2 to 5.0 N, and preferably in the range of from about 0.25 to about 3.0 N.

The electrolyte bath is maintained at a temperature below the boiling point of the bath, preferably between about 130° F. and 200° F., and most preferably at about 185° F.

Delacquering and detinning is accomplished by application of a moderate anodic current, wherein the first electrically conductive container acts as an anode (referred to also as the working electrode), and the removed tin is plated out on the cathode (counter electrode). Anodic charge passes onto metal substrate that comes in contact with the anodically charged walls of the first electrically conductive container. The effective amount of current is empirically determined, and can be readily ascertained by one of ordinary skill in the art, depending on a number of factors, including the composition of the electrolyte solution, the surface area of the cathodes, the current distribution, distance between electrodes, the amount of metal substrate, the thickness of the tin coating, and the like. The voltage is adjusted such that the electrochemical potential is in the range where the tin only is selectively dissolved, between about −1.5 to about −1.0 V relative to a mercurous sulfate reference electrode (hereinafter "MSE"). This method is suitable for the delacquering and detinning of a post-consumer tin can waste.

Figure 1:
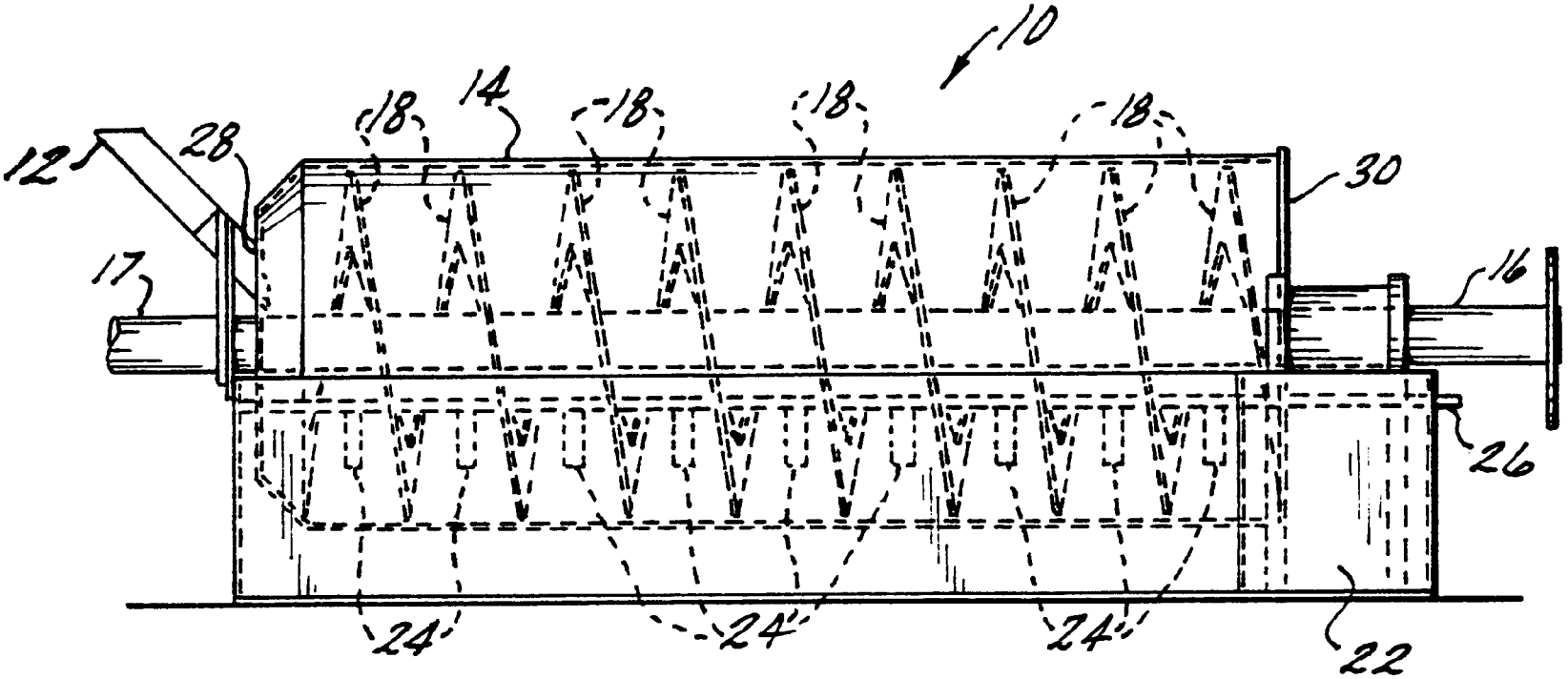
FIG. 1 is a longitudinal vertical sectional view of a preferred embodiment of an apparatus for one-stage removal of polymer and tin coatings from a metal substrate in accordance with the present invention.

An apparatus suitable for carrying out the process of this invention has been disclosed in U.S. Pat. No. 4,056,450 to McCauslan et al., which is incorporated by reference herein in its entirety. Another apparatus as in shown at FIG. 1 at 10 is also particularly suitable for the continuous delacquering and detinning of metal substrates. A feed chute 12 having a discharge opening at its lower end discharges into a hollow foraminous cylinder 14 rotatably mounted beneath chute 12 in close relation thereto. A central cylinder 16 is mounted longitudinally within the foraminous cylinder 14. At least one end 17 of central cylinder 16 extends beyond the foraminous cylinder 14, and is attached to rotatory means known in the art (not shown) to effect rotation of the central cylinder 16 (and thus foraminous cylinder 14).

A plurality of helical members ("flights") 18 are interposed between foraminous cylinder 14 and central cylinder 16, the helical members being arranged to advance the metal substrate through the foraminous cylinder 14. Flights 18 are of a depth, pitch (spacing), and height such that the tin pieces are moved through the apparatus without jamming and to optimize current distribution. Foraminous cylinder 14 is partially submerged in an electrically conductive container 22, having the electrolyte bath solution therein. Electrically conductive container 22 may comprise a tank, drum or the like and preferably is insulated to help maintain the temperatures of the electrolyte bath. A plurality of dangler electrodes in the form of expanded mesh stainless steel cathodes 24 is arranged longitudinally in rows external to the foraminous cylinder 14, the steel cathodes 24 being suspended from a bus bar 26 cathodically connected to a power source (not shown). Bus bar 26 may be composed of titanium coated copper or stainless steel coated copper, or the like. Preferably, the bus bar 26 is composed of stainless steel.

Foraminous cylinder 14 is further perforated, and upon introduction of the metal substrate into the inlet end 28, foraminous cylinder 14 slowly revolves while suspended in electrically conductive container 22 containing the electrolyte solution. The plurality of helical members 18 which divide the annular zone between the inner cylinder 16 and the foraminous cylinder 14 into a corresponding number of separate passageways move the metal substrate from the point of introduction to inlet end 28 to outlet end 30. By reason of the perforations in foraminous cylinder 14, the metal substrate is exposed to the electrolyte bath in which foraminous cylinder 14 is partially immersed.

Preferably, post-consumer tin can scrap is preliminarily slit prior to electrolytic treatment. "Slit" and "slitting" as used herein refers to mechanical size reduction, whereby the cans are cut into "open" form pieces, thereby allowing ready exposure of the entire surface of the metal substrate to the electrolyte solution. "Open" as used herein is inclusive of some curvature, bending and folding of each individual piece, so long as the overall shape of the piece allows ready exposure of every surface of the piece to the bath solutions.

The pieces are of a size to optimize detinning as well as to facilitate baling of the clean metal at the end of the process, e.g. "3×down". Optionally, the metal substrate may further be scored by mechanical means before or after slitting or washing.

Post-consumer tin can scrap is preferably washed prior to electrolytic treatment in order to remove food particles, labels, and the like. Detergent solutions suitable for such washing step are not critical, and known are to those of skill in the art.

As will be discussed in more detail below, the composition of the electrolyte bath is such that lacquer removal occurs substantially electrolytically, rather than by chemical dissolution. Electrolytic removal results in the formation of lacquer chunks which may be removed from the electrolyte bath by filtration. Chemical dissolution on the other hand, results in the lacquer being suspended or dissolved in solution or coalescing into a sludge. Regeneration of the electrolyte solution is difficult in the presence of significant sludge contamination.

Regeneration of the electrolyte bath may require removal of dissolved tin or other metals which have failed to plate out at the cathode. Regeneration methods have been described, for example, in U.S. Pat. No. 4,219,390 to Stuart, et al., which is herein incorporated by reference in its entirety.

Another embodiment of the present invention comprises a two-stage process for removing an outer polymeric coating and an inner tin coating from a metal substrate. The first stage comprises removal of the polymeric coating in a first electrolyte bath through application of a weak cathodic current. This electrolytic process results in removal of even the most inert lacquers in less than one minute. Importantly, none or only trace amounts of tin are dissolved using the disclosed electrolytic process, thus simplifying filtration of the larger lacquer pieces and regeneration and ultimate disposal of the bath. Without being bound by theory, the present method is particularly effective because the application of cathodic current to the coated metal substrate generates small hydrogen gas bubbles which lift off the lacquer mechanically.

In the first stage, a first electrically conductive container is made the cathode (also referred to as a working electrode) and the polymeric and tin coated metal substrate that is immersed in the first electrolyte bath within the first electrically conductive container is cathodically protected (provided they are in electrical contact with the container) which prevents metal dissolution in the first electrolyte bath. This prevents the organic material waste from being contaminated with metal ions. In addition to cathodically protecting the metal substrate, the applied current lifts the lacquer coating off the metal substrate as a single easily removed piece, preferably the size of the metal substrate itself. The anode in the first stage is also referred to as the counter electrode.

In one embodiment, the electrical connection to the first electrically conductive container is made to the outside of the container via wire brushes at several places to minimize ohmic drop. Electric connection to the anode is made via a non-moving axial (centered or above center in the container) bus bar comprising a titanium coated copper. The bus bar may also be comprised of stainless steel, stainless steel coated copper, or the like. The bus bar is not in contact with the first electrolyte bath, the coated metal substrate, or metal components of the rotatable first electrically conductive container. Dangler electrodes in the form of expanded mesh dimensionally stable anodes (DSAR, Ru/Ir oxide coating on titanium) are hung from this bus bar through to the first electrolyte bath and are in contact with the first electrolyte bath. The area of the dangler electrodes is maximized and the distance to the metal substrate is minimized, but no direct contact is made with the metal substrate. At the anode, the oxidation of water to form $O_2$ gas and $H^+$ ions occurs. The $H^+$ ions combine with the $OH^-$ ions of the cathode to form water which maintains the electrolyte pH at its bulk composition.

Importantly, the first electrolyte bath is constituted so as to minimize or eliminate metal dissolution in this first stage. Regeneration and disposal of the first electrolyte bath is thereby greatly simplified. Preferably, the first electrolyte bath comprises at least one preferably essentially neutral detergent or surfactant, such detergent maintaining the pH of the bath below about 15. The pH of the first electrolyte bath is not critical, except in that it is not so high as to dissolve significant quantities of the tin coating. Accordingly, the pH may be in the range from about 0 to about 15, but the preferred pH is in the range from about 5 to about 15.

The first electrolyte bath may for improved conductivity comprise a neutral detergent and/or inorganic salt such as sodium nitrate or it may comprise a weakly caustic alkaline cleaner, combined with optional surfactants, defoamers, wetting agents, and neutral salts for improved conductivity. The amount of surfactant should be sufficient to effect lacquer removal and maintain sufficient conductivity in the electrolyte solution. Where the amount of surfactant is low, for example 1% by weight, the addition of at least one neutral inorganic salt may be required to maintain adequate conductivity. A preferred detergent is available under the trade name SP-76, commercially available from Rem Chemicals, Southington, Conn. A suitable surfactant based neutral cleaner is available under the trade name SP-138, commercially available from Rem Chemicals, Southington, Conn.

A preferred first electrolyte bath solution comprises SP-76 as the detergent in the electrolyte solution. A suitable concentration of SP-76 is 18 wt. % for the delacquering process. The $OH^-$ concentration for 18 wt. % SP-76 is 3.4 N and the pH is 14.54. In another embodiment, the first electrolyte bath solution comprises 5 weight % sodium lauryl sulfate as the surfactant for lacquer removal with 6 weight % sodium sulfate as a supporting electrolyte. The addition of sodium sulfate in an amount of about 6 weight % lowers the voltage requirement for a given current density by almost a factor of three. Addition of sodium sulfate in excess of 6 weight % does not result in a lower voltage.

This first stage is also conducted at lower temperatures than prior processes, in the range from about room temperature to a temperature below the boiling point of the bath, and preferably in the range from about 130 to about 200° F. These lower temperatures simplify operation and greatly reduce operating costs. Complete electrolytic removal of the polymeric coating also facilitates detinning in the second stage of the process. Separation of the overall process into two stages therefore represents a particular advantage of the invention, as it provides lower operating costs, better detinning, and fewer hazardous wastes.

The polymeric and tin coated metal substrate is immersed in the first electrolyte bath for a time period effective to substantially delacquer the tin coated metal substrate. The residence time for delacquering the coated metal substrate may be from about 30 seconds to about 300 seconds, preferably between about 60 seconds and about 120 seconds, depending upon the composition of the electrolyte solution and the current density employed in the process.

The current density employed in the first electrolyte bath is empirically determined, depending on factors such as the lacquer type, the temperature of the bath, and the composition of the electrolyte solution. The preferred current density is in the range from about 0 to about 20 mA/cm$^2$. For example, if the first electrolyte bath is maintained at 190° F., the required current density is about 20 mA/cm$^2$ (129 mA/in$^2$) or a 56,000 A rectifier at about 30 volts is required. If the temperature of the first electrolyte bath can be maintained at about 200° F. or greater, the residence time and current requirements are substantially reduced as the wetting of the lacquer, the ionic conductivity and the electrochemical reaction all increase with temperature.

The second stage comprises removal of the tin coating in a second electrolyte bath via application of a moderate anodic current. Such current results in the selective removal of tin from the metal. A second electrically conductive container acts as an anode, and the removed tin is plated out on the cathode. Preferably, the second electrolyte bath comprises a solution of caustic, including but not being limited to those known in the art such as potassium hydroxide and sodium hydroxide. Preferably, the second electrolyte solution is an approximately 0.2–5.0 N solution of potassium hydroxide, and most preferably about 0.25 to about 3.0 N potassium hydroxide. Addition of other electrolytes such as sodium nitrate or sodium sulfate do not affect tin dissolution.

In one embodiment, the second electrolyte solution is within the second electrically conductive container. The second electrically conductive container is made anodic (referred to also as the working electrode). The composition of the second electrolyte bath and the potential of the metal substrate (although an applied current is used to operate the system) allow the metal (tin) to be selectively dissolved. Preferably, the second electrically conductive container is made of stainless steel and therefore, the stainless steel container and the steel in the metal substrate is made passive under these electrochemical conditions, and hence do not dissolve. Since the tin is selectively removed, the fate of the other potentially hazardous materials, such as chrome, nickel, copper and lead can be controlled. Since the dissolution of tin is selective, the current distribution is not as critical as in the first electrolyte bath. While in the first electrolyte bath, the current is a measure of the electrochemical reaction rate of the reduction of the water to form small $H_2$ gas bubbles and $OH^-$ ions which occurs on all exposed metal surfaces. In the second electrolyte bath, the current is a direct measure of the tin dissolution rate since this reaction occurs selectively.

In one embodiment, the electrical connection to the second electrically conductive container is made to the outside of the second electrically conductive container via wire brushes at several places to minimize ohmic drop. Electrical connection to the cathode (referred to also as the counter electrode) is made via a non-moving axial (centered or above center in the second electrically conductive container) bus bar which preferably is composed of stainless steel. The bus bar may also be composed of titanium coated copper or stainless steel coated copper. The bus bar is not in contact with the second electrolyte bath, metal substrate, or metal components of the rotatable second electrically conductive container. Dangler electrodes in the form of expanded mesh stainless steel cathodes are hung from the bus bar through to the second electrolyte bath and are in contact with the second electrolyte bath. The area of these dangler electrodes is maximized and the distance to the metal substrate is minimized, but no direct contact is made with the metal substrate. The reduction of the tin ions in solution to form tin metal on the cathode along with hydrogen evolution occurs. As a result of this, the cathode will need to be periodically replaced so that the deposited tin metal may be recovered.

The second stage may also be conducted to lower temperatures than those previously used, preferably about 130–200° F., more preferably between about 160–190° F., and most preferably at about 185° F.

The preferred concentration of tin ion (stannate plus stannite) maintained in the second electrolyte bath is in the range from about 5–300 g/L, and preferably about 200 g/L. Increasing tin concentration increases the rate of plating efficiency, but decreases the rate of tin removal, while decreasing the concentration of tin increases the rate of tin removal while decreasing plating efficiency. However in accordance with the present invention, increasing tin ion concentration within the range of from about 5–300 g/L did not appreciably decrease the rate of tin removal.

Monitoring the current of the second electrolyte bath provides data that may be used to monitor the rate of tin removal. It is more important, however, to control the voltages of the second electrolyte bath, in order to maintain the voltage in the correct electrochemical potential region for selective tin dissolution. For example, tin dissolution starts at −1.6 V and terminates at −1.34 V. The maximum dissolution rate occurs at −1.4 V. The activation potentials of pure tin and tin plate are similar; however, the rate of tin dissolution decays more rapidly for tin plate. If the potential is held at −1.4 V, it takes 15 seconds to completely remove tin from the surface of the can. The preferred anodic voltage is in the range from about −1.5 V to −1.0 V, and most preferably −1.15±0.1 V relative to an MSE reference, and the cathodic voltage is in the range from about −2.15 V to −2.35 V relative to an MSE reference.

The metal substrate is immersed in the second electrolyte bath for an empirically-determined time period effective to substantially detin the metal substrate. The residence time for detinning the metal substrate will depend on the thickness of the tin layer, the current used for detinning, the electrolyte solution and the like. The residence time for the detinning process in the Examples described below was between 40 and 125 seconds for 3.0 and 1.0 M KOH at room temperatures and a current density of 5 mA/cm$^2$. As the temperature was raised to 80° C. the potential range of the active region increased and the tin dissolution behavior was characteristic of tin dissolution in acidic environments. The residence time of the second stage does vary with a change in the temperature of the bath. The residence time did not change significantly with temperature. For example, in one embodiment, if the second electrolyte bath is maintained at about 190° F., the required current density is about 5 mA/cm$^2$ (32 mA/in$^2$) or a 14,000 A rectifier at about 30 volts is required. If the second electrolyte bath can be maintained at temperature of about 200° F. or greater, the residence time and current requirements are reduced; however, the reduction is not significant when compared with economical and safety considerations.

This method is particularly suitable for the delacquering and detinning of post-consumer tin can scrap. When so used, the first stage is preferably preceded by the slitting, washing, and optional scoring steps described above.

Figure 2:
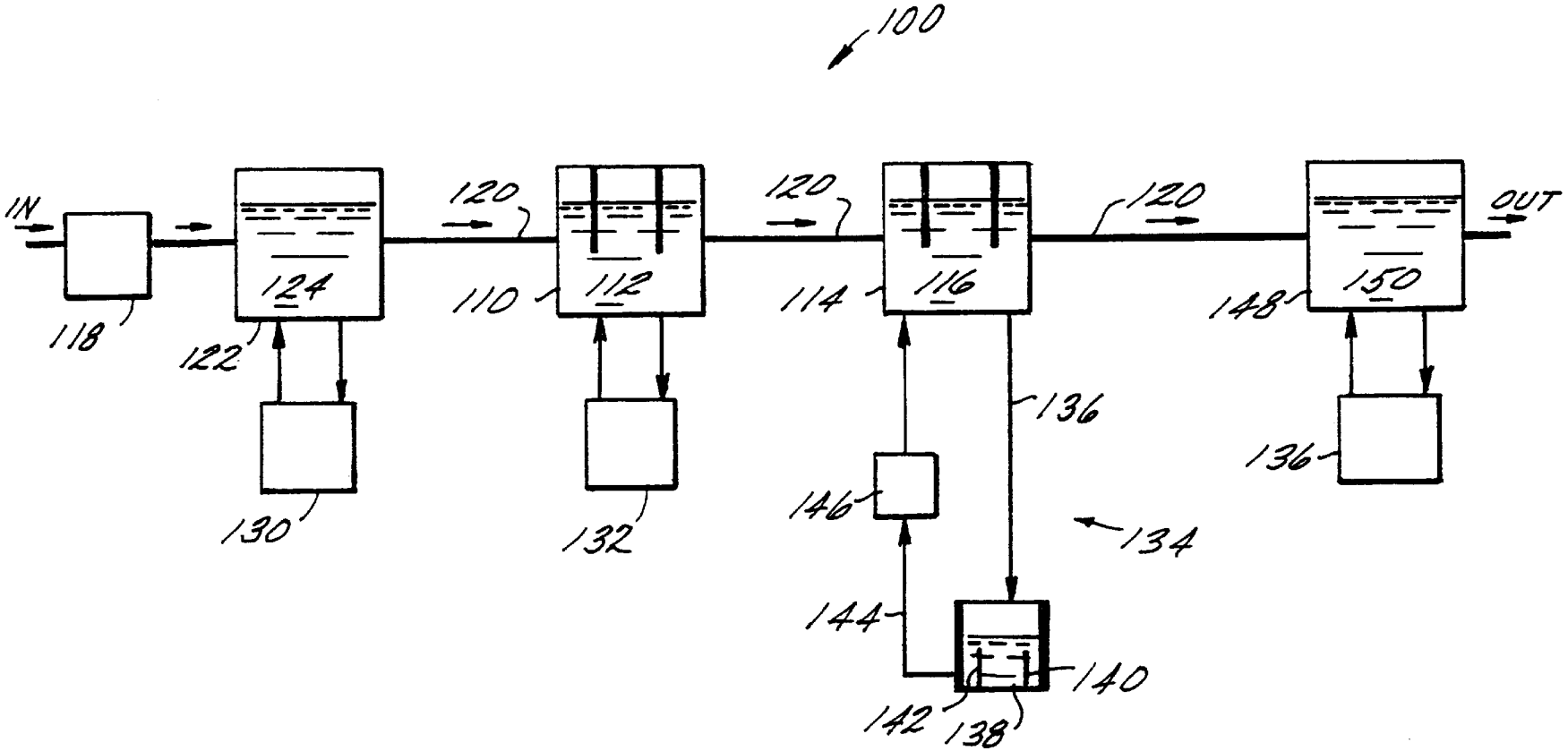
FIG. 2 is a schematic diagram of a preferred embodiment of an apparatus for delacquering and detinning post-consumer tin can waste in accordance with the present invention.

A schematic diagram of an apparatus 100 for use with the two-stage process in accordance with the present invention is shown at FIG. 2. Accordingly, the apparatus comprises a first electrically conductive container (e.g. tank or drum) 110 having a first electrolyte solution 112 therein, the first electrically conductive container being for delivery of a cathodic current for removal of an outer polymeric coating from a polymeric and tin coated metal substrate. A second electrically conductive container (e.g. tank or drum) 114 having a second electrolyte solution 116 therein is further provided, the second electrically conductive container being arranged for delivery of an anodic current for electrolytic removal of tin from the coated metal substrate. A conveyor 120 delivers the de-polymerized (i.e., de-enameled or delacquered) tin coated metal substrates from the first electrically conductive container 110 to the second electrically conductive container 114. Any suitable means known in the art may be used to convey the tin cans to the first tank, for example, a magnet in conjunction with a conveyor belt. Each tank or drum is electrically isolated from the rotatory mechanism that drives it, as well as from the other tanks or drums, in order to achieve the desired electrochemical parameters.

Preferably, the apparatus in accordance with this embodiment of the invention further comprises a slitter 118, which effects mechanical size reduction of the metal substrate to open pieces. A conveyor 120 delivers the slit pieces to a preliminary washing tank (or drum) 122 having a washing solution 124 therein, where the slit pieces are washed. In the case of post-consumer tin cans, the pieces are washed of food particles, labels, glue, and other debris. Conveyor 120 further delivers the washed pieces to the first electrolyte bath container 110. Conveyor 120 delivers the delacquered and detinned substrate metal from second electrically conductive container 114 to a final rinse tank 148 having a rinse solution 150 therein. The substrate metal is rinsed of any foreign material that may exist. Conveyor 120 delivers the rinsed substrate metal to appropriate channels of storage or transportation from the rinse tank 148.

Each tank or container further comprises a separate fluid maintenance system, 130, 132, 134, and 136. Particularly with regard to recycling of post-consumer tin cans, the second electrolyte bath solution 116 is regenerated by system 134, wherein the solution is removed through conduit 136 and circulated through tank 138 fitted with cathodes 140 and anodes 142. Application of current results in the dissolved tin depositing onto the cathodes. The detinned solution is then circulated through conduit 144 to cation exchanger 146 for removal of other metals, and then returned to the second electrically conductive container 114.

Figure 3A:
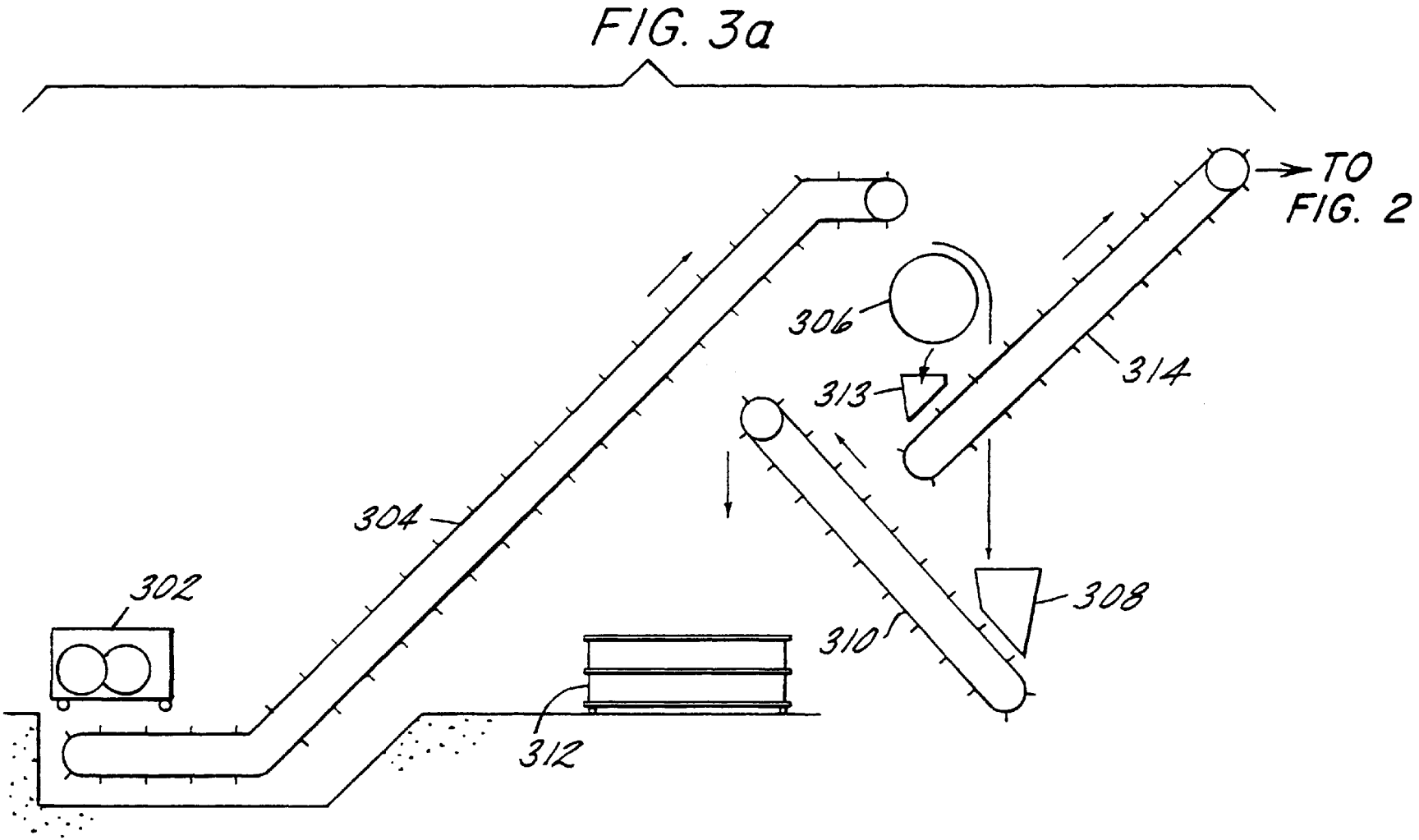
FIG. 3*a* is a longitudinal vertical sectional view of a first portion of the preferred embodiment of an apparatus for two-stage removal of polymer and tin coatings from a metal substrate in accordance with the present invention.

Another embodiment, as shown in FIG. 3*a*, comprises a two-stage process for removing an outer polymeric coating and an inner tin coating from a metal substrate. The first stage comprises removal of the polymeric coating in a first electrolyte solution in a first electrically conductive container through application of a weak cathodic current. As is conventionally known, polymeric and tin coated metal substrate is transported and bundled into bales. The coated metal substrate bails are broken by bale breaker 302 releasing the coated metal substrate onto conveyor 304 which transports the coated metal substrate to a top feed magnetic separator 306.

Conveyor 304 comprises a conveyor known in the art. Top feed magnetic separator 306 is a top feed drum magnet which comprises a drum having a 6 foot diameter, a width of 4 feet, and a speed of 500 ft/min. Magnetic separator 306 causes non-metallic substrate to be directed to hopper 308 which feeds the non-metallic substrate, e.g. paper, plastic, glass, aluminum, to conveyor 310. Conveyor 310 transports the non-metallic substrate to container 312 which collects the non-metallic substrate. Non-metallic substrate may then be gathered and disposed of accordingly.

Figure 3B:
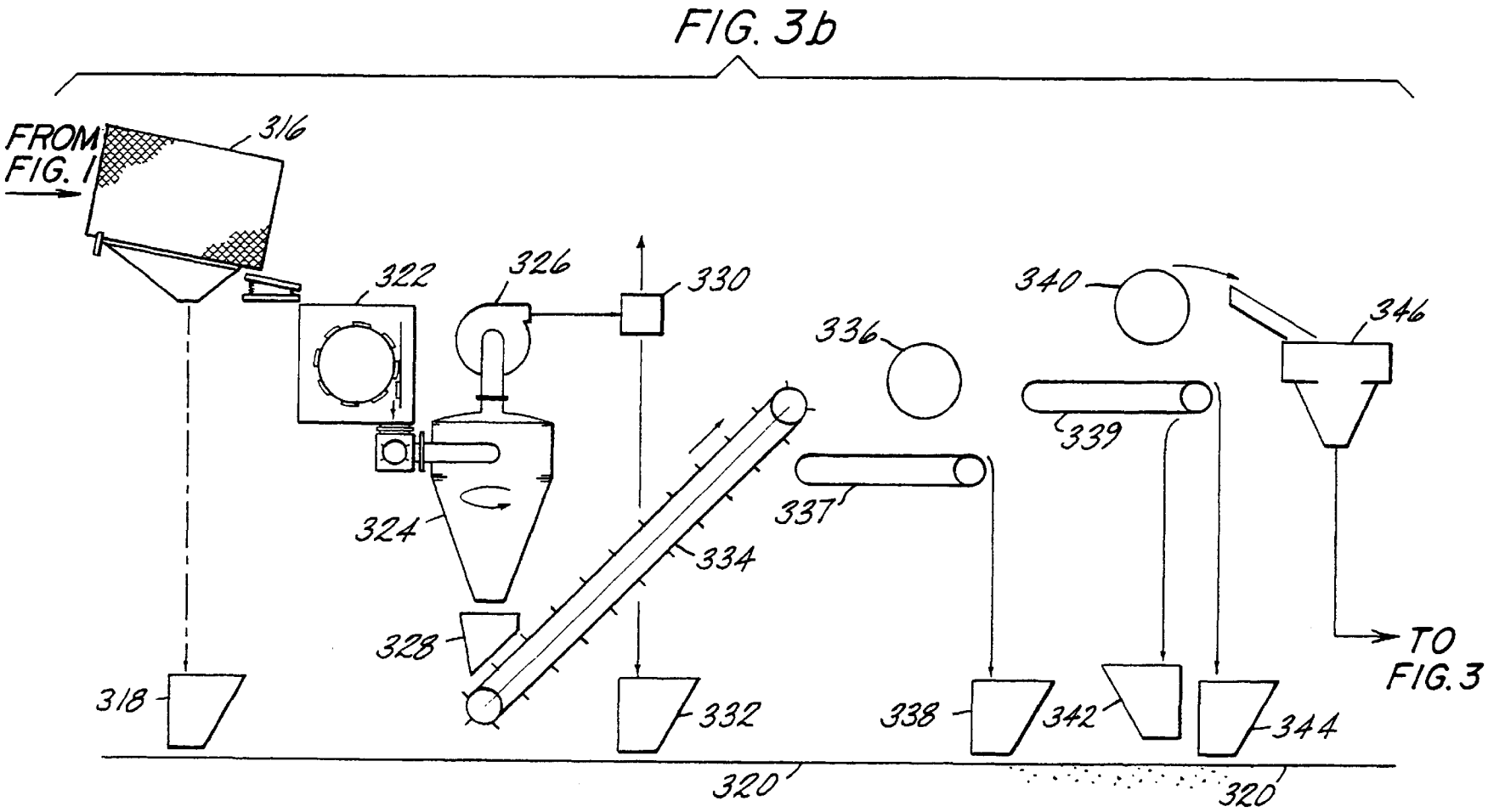
FIG. 3*b* is a longitudinal vertical sectional view of a second portion of the preferred embodiment of an apparatus for two-stage removal of polymer and tin coatings from a metal substrate in accordance with the present invention.

Coated metal substrate enters hopper 313 which feeds the metal substrate to conveyor 314 which transports the coated metal substrate to filter screen 316, as shown in FIG. 3*b*. Filter screen 316 removes any dirt or other foreign material from the coated metal substrate. Any dirt or foreign material passes through filter screen 316 into hopper 318 which directs the dirt and foreign material to a floor conveyor 320 where the matter is transported and then disposed of accordingly. After the coated metal substrate passes over filter screen 316, it is then introduced in a crusher or slitter 322 in which the coated metal substrate is cut into "open" form pieces, thereby allowing ready exposure of the entire surface of the coated metal substrate to the electrolyte solution. The pieces are of a size to optimize detinning as well as to facilitate baling of the clean metal at the end of the process, e.g. "3×down".

The coated metal substrate is then introduced into a cyclone separator 324 having a fan 326. Cyclone separator 324 is a gravity fed separator where the coated metal substrate is fed to hopper 328 and paper and other foreign material is directed to drop out chamber 330 by fan 326 or other means. Paper, such as labels, passes from drop out chamber 330 to hopper 332 which feeds the material to floor conveyor 320 which transports the material for disposal. After the coated metal substrate is introduced into hopper 328, it is fed onto conveyor 334 which transports the coated metal substrate to drum magnet separator 336.

Drum magnet separator 336 separates the coated metal substrate from non-metallic material and directs non-metallic material onto conveyor 337 which transports the non-metallic material to hopper 338 and fed into floor conveyor 320 which transports the material for disposal. Coated metal substrate is directed onto conveyor 339 which transports the coated metal substrate to drum magnet separator 340 which further separates the coated metal substrate from non-metallic material. Non-metallic material is directed to hopper 342 and 344 and fed to floor conveyor 320 which transports the material for disposal.

Figure 4A:
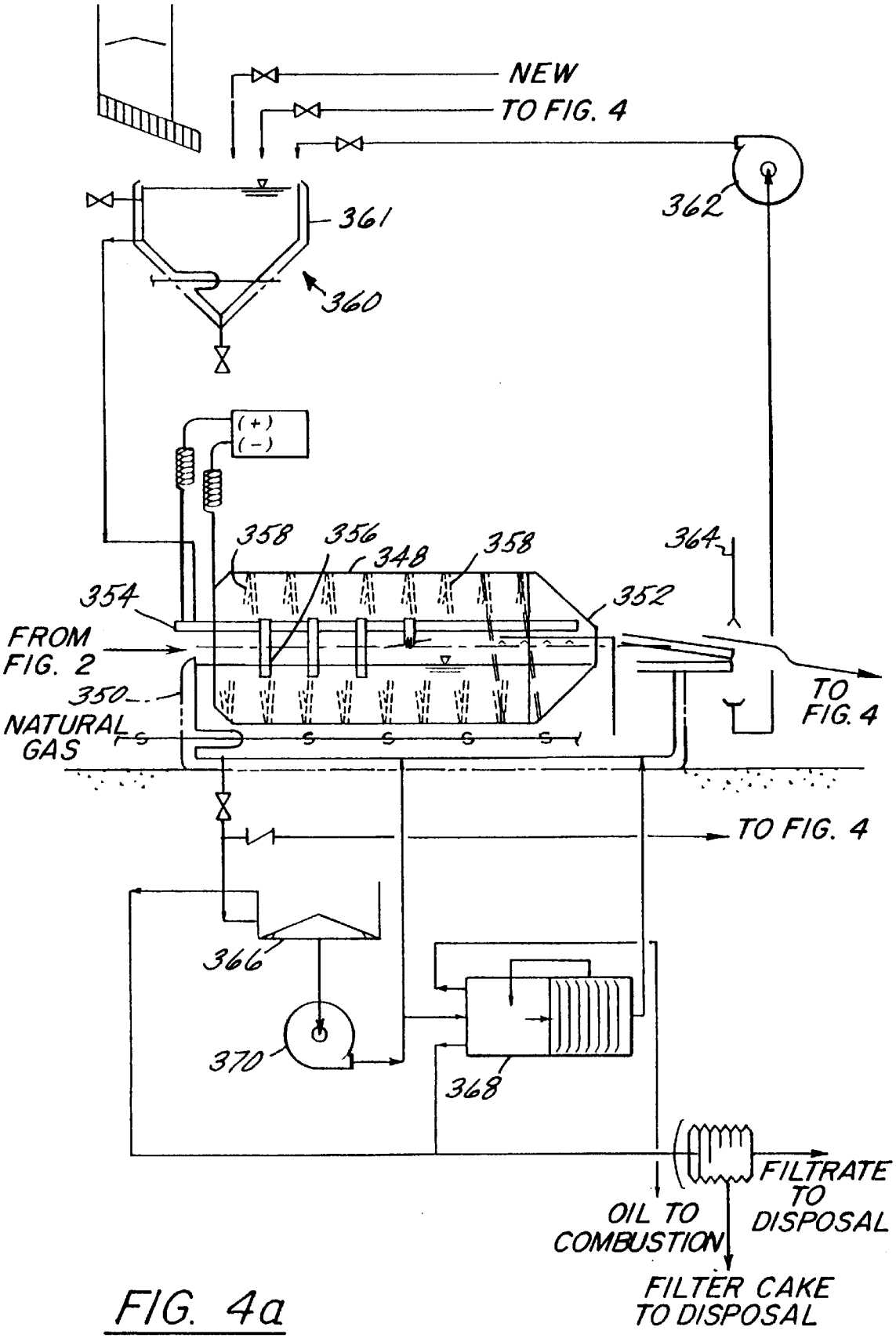
FIG. 4*a* is a longitudinal vertical sectional view of a third portion of the preferred embodiment of an apparatus for two-stage removal of polymer and tin coatings from a metal substrate in accordance with the present invention.

Coated metal substrate is then directed to feed chute 346 which feeds the coated metal substrate to first electrically conductive container 348, as shown in FIG. 4*a*. First electrically conductive container 348 may comprise a perforated rotating internal helix drum (or tank) that is disposed within an electrolyte bath container 350 or first electrically conductive container 348 may comprise a non-perforated rotating internal helix drum (or tank) which eliminates the need for electrolyte bath container 350 (not shown). A suitable internal helix drum (or tank) has a diameter of approximately 6 to 8 feet and preferably is insulated to maintain the temperature of the first electrolyte solution. The rotation rate of the container dictates the length of the drum and is about 2 to 6 rpm. At least one end 352 of the first electrically conductive container 348 is attached to rotatory means known in the art (not shown) to effect rotation of the first electrically conductive container 348.

First electrically conductive container 348 is electrically isolated from the rotatory mechanism that drives it, as well as from other containers or washing tanks, in order to achieve the desired electrochemical parameters. First electrically conductive container 348 is electrochemically connected so that it acts as a cathode. The anode is a bus bar 354 with dangler electrodes 356 in the form of DSA—Dimensionally Stable Anode (titanium with ruthenium oxide coating). Bus bar 354 may be comprised of titanium coated copper, stainless steel, stainless steel coated copper, or the like. The dangler electrodes 356 are arranged so that they do not touch the machine's internal parts or the metal substrates themselves, or a short circuit will occur. Polymeric and tin coated metal substrate is delivered to the first electrically conductive container 348 by a feed chute 346 or by other means known in the art such as a conveyor.

The first electrolyte solution is provided in the first electrically conductive container 348 in a quantity sufficient to immerse the polymeric and tin coated metal substrate as it advances through the container 348 by means of helical flights 358. Helical flights 358 are of a depth, pitch (spacing) and height such that the coated metal substrate is moved through the apparatus without jamming. First electrolyte solution is pumped, scooped, or flows into the helix within the electrically conductive container 348 so that a sufficient quantity of first electrolyte solution is present within the container 348 to electrochemically remove the polymeric coating from the metal substrate. First electrolyte solution is preferably continuously refreshed and provided in the first electrically conductive container 348 from a refreshment source of the first electrolyte solution. The refreshment system 360 contains a significant amount of premixed chemical solution and preferably the refreshment system 360 comprises a tank 361 of approximately 200–300 gallon capacity. The solution in the refreshment tank is maintained at a minimum of at least about 185° C. Powdered chemicals are metered into the refreshment tank and the concentration of the solution is monitored. Pump 362 or other means know in the art continuously refreshes the first electrolyte solution by introducing it to refreshment system 360 from first electrically conductive container 348 and then subsequently introducing it back into the first electrically conductive container 348.

Polymeric and tin coated metal substrate is immersed in the first electrolyte solution and crawls up the sides of the container and tumbles due to the movement of the first electrically conductive container 348 and the internal helical flights 358 thereby exposing as much of its surface area as possible to electrochemical action on all sides. Helical flights 358 are placed to allow easy movement of the tangled shredded coated metal substrate. The height of the helix is to be about 4 to 6 inches and the spacing between the flights 358 of the helix is such that the residence time for the first solution is approximately 3.5 minutes and the residence time for the second solution is approximately 3.5 minutes.

First electrically conductive container 348 may optionally have at least one spray nozzle 364 to spray the coated metal substrate that has substantially moved through the container 348. Spray nozzle 364 sprays the shredded metal substrate with the first electrolyte solution at a pressure of about 60 psi to remove labels and other waste that still remains on the metal substrate. Preferably, the spraying occurs at a location where there is still some tumbling of the metal substrate as it moves through the container 348 in order for the spray to effectively contact all of the surface of the metal substrate. There may also be provided a spray nozzle which dispenses a rinse solution of hard water; however, the hard water rinse is not recirculated to the first electrically conductive container 348 but is disposed of by means known in the art. If a hard water rinse is employed, then preferable the spray nozzle disposing this rinse is located exterior to both the first electrically conductive container 348 and the electrolyte bath container 350 so that the rinse is not introduced into either container.

Optionally, the first stage also includes a coarse filtering system 366 and a fine filtering system 368. Coarse filtering system may comprise a shaker screen with a conical screen with a wiper arm or a flat screen with no wiper arm. Suitable screen sizes range from 70 microns to 50 mesh and preferably, the system should process at least 500 gal/min. First electrolyte solution is introduced to coarse filtering system 366 which filters out foreign material such as labels and polymeric (lacquer) flakes. After passing through the coarse filtering system 366, some of the first electrolyte solution is directed by pump 370 or other means to fine filtering system 368 and some of the first electrolyte solution is directed back into the first electrically conductive container 348.

Fine filtering system 368 may comprise a ceramic membrane filter or other filtering membranes known in the art. Preferably, the membrane filter has pore sizes small enough for the contaminants to stay on the surface so that the periodic back flush loosens the contaminant particles and sends them on to the concentrate. However, the pore size must not be so small as to filter out soap molecules. Under such a fine filtering system, there generally will be at least four waste outputs: (1) shaker screen solids, (2) oil layer from first electrically conductive container, (3) sludge layer from the first electrically conductive container, and (4) chemical cleaning solution. The sludge layer and the shaker screen solids are combined and go to a filter press 372 or alternative dewatering device. The filter cake that is generated is disposed of accordingly. The liquid filtrate from the filter press is directed to a suitable disposal means. Waste oil preferably is incinerated for heat value.

Figure 4B:
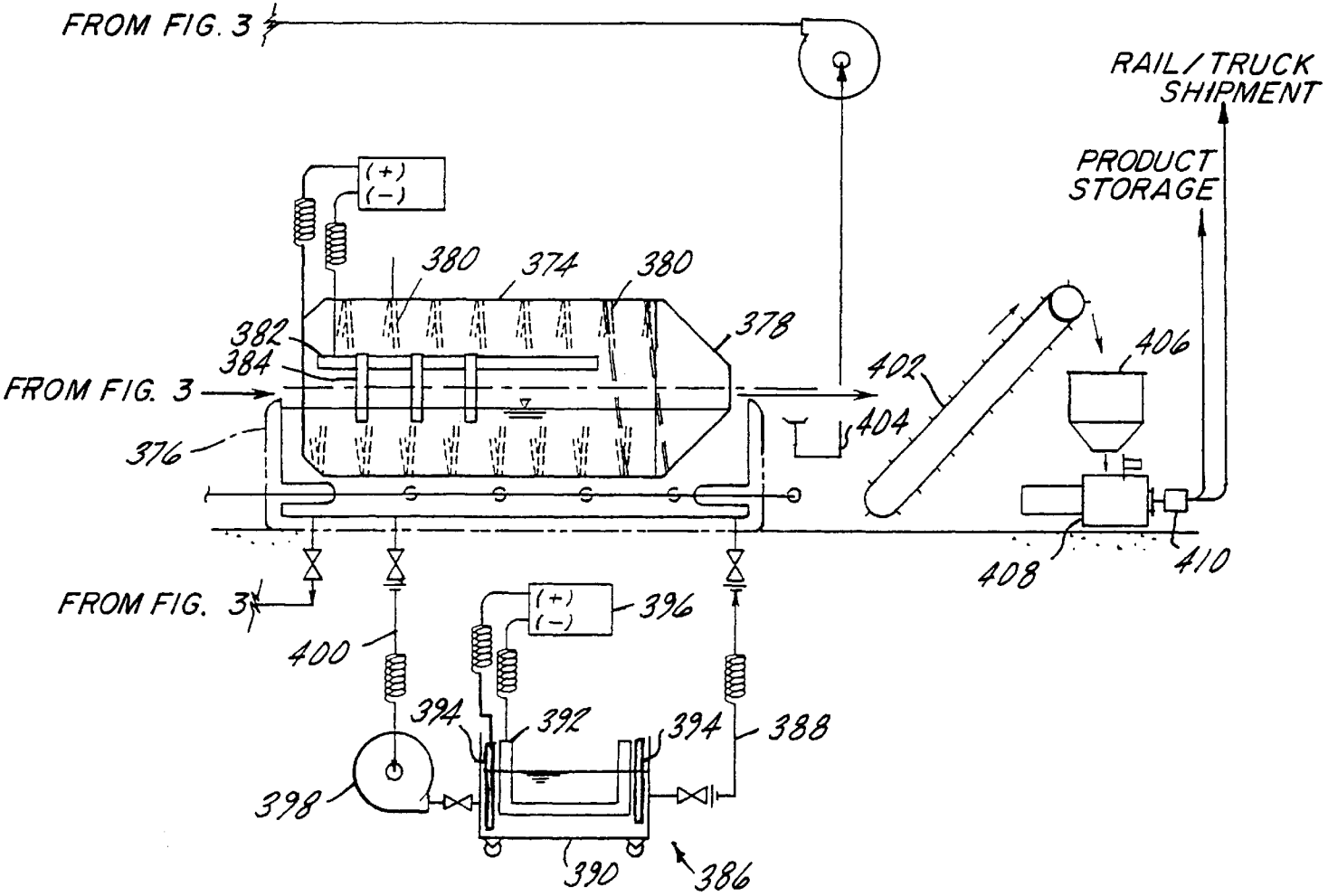
FIG. 4*b* is a longitudinal vertical sectional view of a fourth portion of the preferred embodiment of an apparatus for two-stage removal of polymer and tin coatings from a metal substrate in accordance with the present invention.

As shown in FIGS. 4*a* and 4*b*, first electrically conductive container 348 is connected to a second electrically conductive container 374 by means of a conveyor or other means that transports the de-polymerized substrate from first electrically conductive container 348 to the second electrically conductive container 374. Second electrically conductive container 374 may comprise a perforated rotating internal helix drum (or tank) having a diameter of approximately 6 to 8 feet, and preferably is insulated to maintain the temperature of the second electrolyte solution. The perforated second electrically conductive container 374 is placed in a bath of the second electrolyte solution so that second electrolyte solution may freely pass into the second electrically conductive container 374. The bath of second electrolyte solution is disposed within an electrolyte bath container 376 holding second electrolyte solution and second electrically conductive container 374 is itself disposed within electrolyte bath container 376. At least one end 378 of the second electrically conductive container 374 is attached to a rotatory means known in the art (not shown) to effect rotation of the second electrically conductive container 374. Second electrically conductive container 374 is electrically isolated from the rotatory mechanism that drives it, as well as from the first electrically conductive container 348. Second electrically conductive container 374 acts as an anode (also referred to as the working electrode) and passes anodic charge onto metal substrate that comes in contact with the walls of the second electrically conductive container 374. The anodic charge is translated throughout the bulk of the metal substrate from contact of the individual metal substrate pieces with each other.

Second electrolyte solution is provided in the second electrically conductive container 374 in a quantity sufficient to immerse the metal substrate as it advance through the second electrically conductive container 374 by means of the above-described helical flights 380. The composition of the second electrolyte solution and potential of the metal substrate fragments (through an applied current is used to operate the second stage) allow the metal (tin) to be selectively dissolved. The second electrically conductive container 374 is preferably made of stainless steel and is made passive, along with the steel of the metal substrate (tin can), under these conditions and hence does not dissolve. The height and/or electrically conductivity of helical flights 380 within the second electrically conductive container 374 is such so as to minimize ohmic drop and the metal substrate must be constantly turned over from top to bottom of the flow so that the metal substrate is exposed to the cathode of the apparatus to insure that tin is removed from each metal substrate.

Electrical connection to the second electrically conductive container 374 is made to the outside of the second electrically conductive container 374 via wire brushes at several places to minimize ohmic drop. Electrical connection to the cathode (also referred to as the counter electrode) is made via a non-moving axial (centered or above center in the container 374) bus bar 382 comprised of stainless steel coated copper. Bus bar 382 may also be comprised of titanium coated copper, stainless steel, or the like. The bus bar 382 is not in contact with the solution, metal substrate or metal components of the rotating second electrically conductive container 374. Bus bar 382 is cathodically connected to a power source (not shown). The cathode for the second electrically conductive container 374 may be interior to the second electrically conductive container 374 or it may be exterior. If second electrically conductive container 374 is perforated, then the cathode is preferably disposed within the electrolyte bath container 376 but exterior to second electrically conductive container 374 but may be disposed within second electrically conductive container 374 or at least one cathode may be disposed within second electrically conductive container 374 and a plurality of cathodes in the form of dangler electrodes may be disposed exterior to the second electrically conductive container 374 but within the electrolyte bath container 376. Dangler electrodes in the form of expanded mesh stainless steel cathodes 384 are hung from bus bar 382 through to the second electrolyte solution and are in contact with the second electrolyte solution. The area of these dangler cathodes 384 must be maximized and the distance to the metal substrate minimized, but no direct contact must be made with the tin coated metal substrate. The reduction of tin ions in solution to form tin metal on the cathode along with hydrogen evolution will occur. This requires that the cathode be replaced periodically so that the deposited tin metal can be recovered.

In still a further embodiment, second electrically conductive container 374 comprises a non-perforated rotating internal helix drum (or tank) having a diameter of approximately 6 to 8 feet, and preferably is insulated to maintain the temperature of the second electrolyte solution within the second electrically conductive container 374. In this embodiment, preferably, electrical connection to the cathode (also referred to as the counter electrode) is made via the above-described bus bar 382 and the cathode for the second electrically conductive container 374 is preferably disposed within the second electrically conductive container 374. Bus bar 382 and dangler electrodes 384 are disposed within the second electrically conductive container 376 and dangler electrodes in the form of expanded mesh stainless steel cathodes 384 are hung from bus bar 382 through to the second electrolyte solution and are in contact with the second electrolyte solution.

Figure 4C:
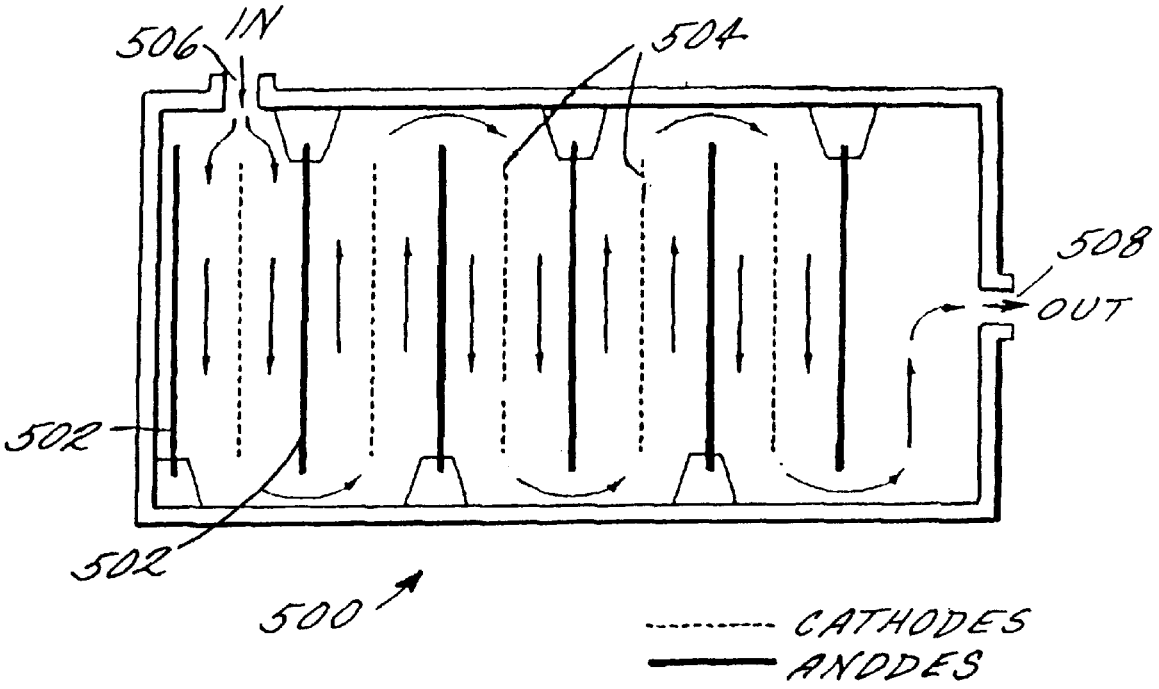
FIG. 4*c* is a top plan view of a suitable metal recovery system.

The second electrolyte solution is continuously regenerated by system 386, wherein the solution is removed through conduit 388 and circulated through tank 390 fitted with cathodes 392 and anodes 394. Cathodes and anodes are a series of alternating plates wherein plates connected anodically alternate with plates connected cathodically to form the series of plates whereby the second electrolyte solution is in intimate contact with both the anodic and cathodic plates as it passes through tank 390. System 386 includes a power source and rectifier 396 and a pump 398 or the like. Application of current results in the dissolved tin plating out onto the cathodes. The detinned solution is then circulated through conduit 400 to the second electrically conductive container 374. Some tin is plated out onto dangler cathodes 384 within the second electrically conductive container 374 but the majority is plated out on the cathode in tank 390 by means of continuous regeneration of the second electrolyte solution. System 386 is detachable from second electrically conductive container 374 and therefore allows freedom to move system 386 for cleaning thereof, maintenance thereof, etc. A suitable system is illustrated in FIG. 4*c* which depicts a metal recovery system commercially available under the trade name IONNET® Cell from the Precious Metal Processing Consultants Inc. This system 500 comprises a series of plates 502 anodically connected to a power source and an alternating series of plates 504 cathodically connected to a power source. Second electrolyte solution is introduced into system 500 at port 506 and passes through system 500 and is in intimate contact with anodic plates 502 and cathodic plates 504. Tin is plated out onto cathodic plates 504 before the detinned solution exits system 500 through port 508 and is introduced back into the second electrically conductive container 374. Another suitable system is a chrome recovery system commercially available under the trade name RETEC® from ELTECH International Corporation.

After the metal substrate advances through the second electrically conductive container 374 and is detinned, the metal substrate exits the second electrically conductive container 374 and is introduced onto conveyor 402 which optionally connects the second electrically conductive container 374 to a final rinse tank (not shown) where the detinned and delacquered substrate metal is washed. In another embodiment, a spray nozzle 404 is provided in the second stage and the detinned and delacquered substrate metal is pressure sprayed with a solution to remove any foreign material that may still remain on the substrate metal.

Conveyor 402 transports the substrate metal to a feed hopper 406 which feeds the substrate metal to a baler 408 which bales the substrate metal. Bales may then be marked at a bale marking station 410 before they are transported to a product storage site or for rail/truck shipment.

In still a further embodiment, the polymeric and tin coated metal substrate is immersed in a preliminary wash tank (drum or the like) prior to being fed into the feed chute connected to the first electrically conductive container (not shown). The preliminary wash tank contains a wash solution which removes any paper, dirt, or foreign material that may be present on the polymeric and tin coated metal substrate prior to immersion in the first electrolyte solution. A final rinse tank (drum or the like) may also be provided for rinsing the delacquered and detinned substrate metal after it exits the second electrically conductive container. Both the preliminary wash tank and final rinse tank are connected to the overall apparatus by use of conveyors known in the art. This apparatus further illustrates an important advantage of the present invention, wherein the components of the electrolyte solution are selected such that carry-over of electrolyte solution from a preceding tank/container into the next tank/container does not materially affect the functioning of the next tank/container.

Where carry-over is nonetheless desired to be minimized, an alternative embodiment (not shown) of an apparatus suitable for the two-stage electrolytic methods in accordance with the present invention comprises the use of intermediate tanks positioned between preliminary wash tank and first electrically conductive container, between first electrically conductive container and second electrically conductive container, and between second electrically conductive container and final rinse tank. Each of these intermediate tanks collect any carry-over from the preceding tank, and the carry-over may be returned to the preceding tank by use of conduits (not shown).

For a commercial facility in accordance with the present invention, two 3000 amp, 10 volt power supplies are preferred for a feed rate of 80 lb/minute of slit tin cans. The loading of resin is 475 grams/minute for 80 lb/minute of post-consumer scrap tin cans. Other parameters are shown below in Table 1.

TABLE 1

| Parameter | Range | Preferred Range |
|---|---|---|
| Bath Temperatures | 130–200° F. | 160–1.80° F. |
| Cathodic Current (Lacquer Removal) | 0.05–0.25 A/cm$^2$ | 0.2 A/cm$^2$ |
| Anodic Voltage* (Tin Removal) | −1.5 to 1.0 V | −1.15 +/_ 0.1 V |
| Cathodic Voltage* (Tin Removal) | — | −2.25 +/_ 0.1 V |

*vs. MSE Reference

Still another embodiment of the present invention comprises the above-described two stage process, wherein the preliminary washing stage occurs in the same electrolyte bath as the first lacquer removal stage. The composition and conditions regarding this bath are essentially identical to the above-described first electrolyte bath. As with the above-described embodiment, application of a cathodic current to the polymeric and tin coated metal substrate removed the polymeric layer from the tin coated metal substrate, and the second stage comprises removal of the tin coating via application of a moderately anodic current to a second electrically conductive container.

While the above-described methods and apparatus are suitable for removing an outer polymeric coating and an inner tin coating from steel cans, it is further suitable for removing an outer polymeric coating and an inner tin coating from other polymer/tin/metal or polymer/tin/metal alloy composites. Such metals and metal alloys include, but are not limited to, iron, chromium, copper, nickel, and their alloys, provide that such metals and metal alloys are passive in the electrochemical potential region where tin is active. Such metals should further be inert in the electrolyte baths used in the present processes.

When used to recycle post-consumer tin can scrap, the electrolytic methodology and apparatus of this invention is designed to produce clean steel, free of tin. This is in contrast to the current focus on clean tin production. By designing the process and apparatus to achieve efficiency in complete tin removal, rather than tin cathode purity, low processing costs and effective performances are obtained, while at the same time avoiding the generation of hazardous wastes. The two-stage process in particular allows the segregation of metal and non-metal wastes, thus simplifying regeneration and disposal. Even the detinning bath is "cleaner" than hereto for achieved, as various tramp metals which might ordinarily be left in the electrolyte bath are instead plated out onto the tin cathodes.

Accordingly, these methods and apparatus provide a cost-effective alternative to recycling of post-consumer tin can scrap. The tin-free, low residual steel produced by the disclosed process will obtain premium prices, and secure a stable, high demand for this product in the steel scrap market.

Other features and advantages of the present invention are illustrated by the following examples, which are described for the purpose of illustration rather than limitation.

EXAMPLES

Example 1

The effect of various electrolytes on the residence time required for removal of an epoxy phenolic-type lacquer was examined by applying a cathodic (reductive) current density of 0.5 A/cm$^2$ to a 2-cm$^2$ lacquer- and tin-coated coupon in an aqueous bath maintained at 175° F. Formation of hydrogen gas was observed at the electrodes, and the lacquer layers separated quickly from the electrodes. Lacquer removal times for ten samples were averaged for each electrolyte. The results are presented in Table 2 below:

TABLE 2

| Electrolyte | Removal time (seconds) |
|---|---|
| $KNO_3$ (1.0 N) | 60 |
| $NaNO_3$ (1.0 N) | 107 |
| Sodium Lauryl Sulfate (5% by weight) | 20 |
| Distilled Water | 70 |

Although all tested electrolytes removed the lacquer layers quickly, a 5% by weight solution of sodium lauryl sulfate, a detergent (surfactant), removed the lacquer the fastest. Such detergent solutions are further advantageous in that they yield pH-neutral solutions that will not dissolve appreciable quantities of tin or steel.

Samples from ten different of lacquer-coated tin cans, representing ten different lacquer types were obtained and tested as described above using a 5% by weight solution of sodium lauryl sulfate. In each instance, the lacquer was quickly and completely removed. All lacquer types were removed at close to the same rate, in contrast to chemical dissolution methods which removed various lacquer types at different rates, and some types not at all.

Use of anodic (oxidative) current in a 5% by weight sodium lauryl sulfate solution resulted in dissolution of the underlying tin and steel.

Example 2

A set of $2^3$ central composite experiments were performed in order to compare the effectiveness of chemical dissolution with the electrolytic tin removal used in the present invention, using a caustic (potassium hydroxide) electrolyte solution and dissolved tin in the form of $K_2Sn(OH)_6$.

A first $2^3$ central composite experiment demonstrated that optimal chemical dissolution of tin requires higher temperatures, higher concentrations of potassium hydroxide, and longer hold times.

A second $2^3$ central composite experiment demonstrated that optimal electrolytic removal of tin is unaffected by temperature. The experiment further showed the existence of a saddle point at 2.0 N KOH and 150 g/L tin. Moving away from this saddle point in the direction of high KOH/high tin or low KOH/low tin provided the most acceptable detinning results. Different, or additional saddle points may exist depending on the composition and conditions of the electrolyte solution.

Example 3

Iron, copper, zinc, chromium, lead, aluminum, and nickel were all tested in the same electrochemical potential region in which tin dissolves. The results demonstrate that iron, copper, chromium, and nickel are all passive in the relevant electrochemical potential region. Zinc is active at lower potential than tin, but still passive in the tin dissolution region. Lead and aluminum are both active in the relevant electrochemical potential region. Using an electrolyte solution saturated with lead nitrate hinders further dissolution of lead.

Example 4

Figure 5:
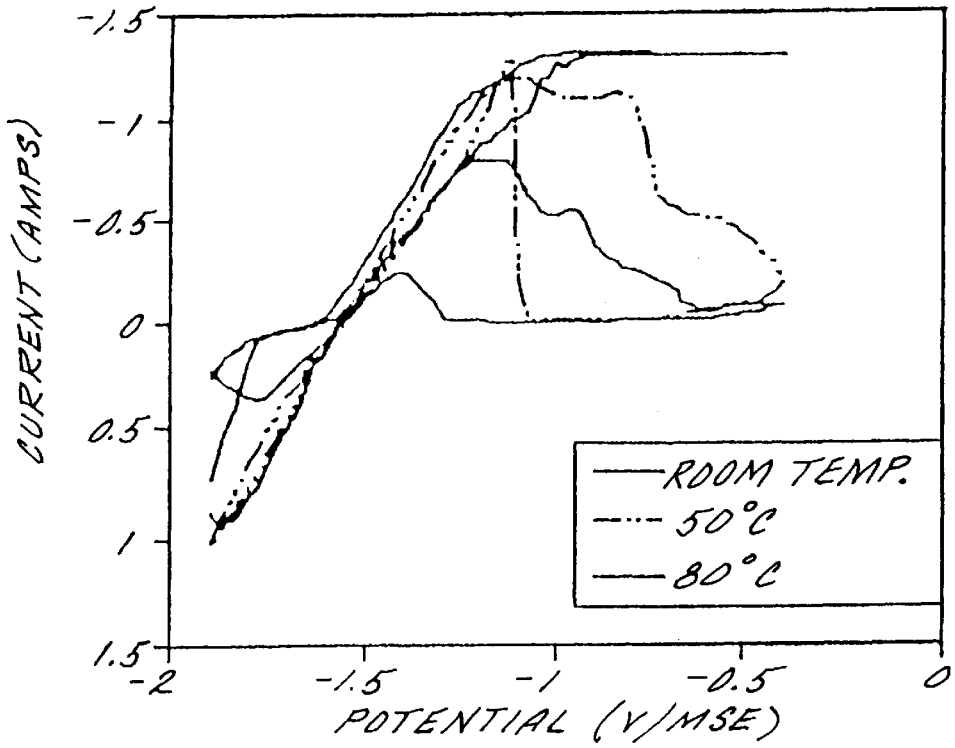
FIG. 5 illustrates the polarization behavior of tin plate in 3M KOH as a function of temperature.

In order to determine the effect of temperature on detinning, the polarization of tin plate in 3 M KOH was measured at room temperature, 50°, and 80° C. As shown in FIG. 5, the potential range of the active-to-passive regime increased with increasing temperature. This indicates that tin oxidation, which results in the formation of tin oxide/hydroxide was inhibited at the higher temperatures. At potentials more negative than −1.3 V (MSE), the rate of tin dissolution was independent of temperature. For more noble potentials, the potential range of the active region increased. At 80° C., the formation of tin oxide/hydroxide was not observed out to −0.4 V (MSE).

Example 5

Figure 6A:
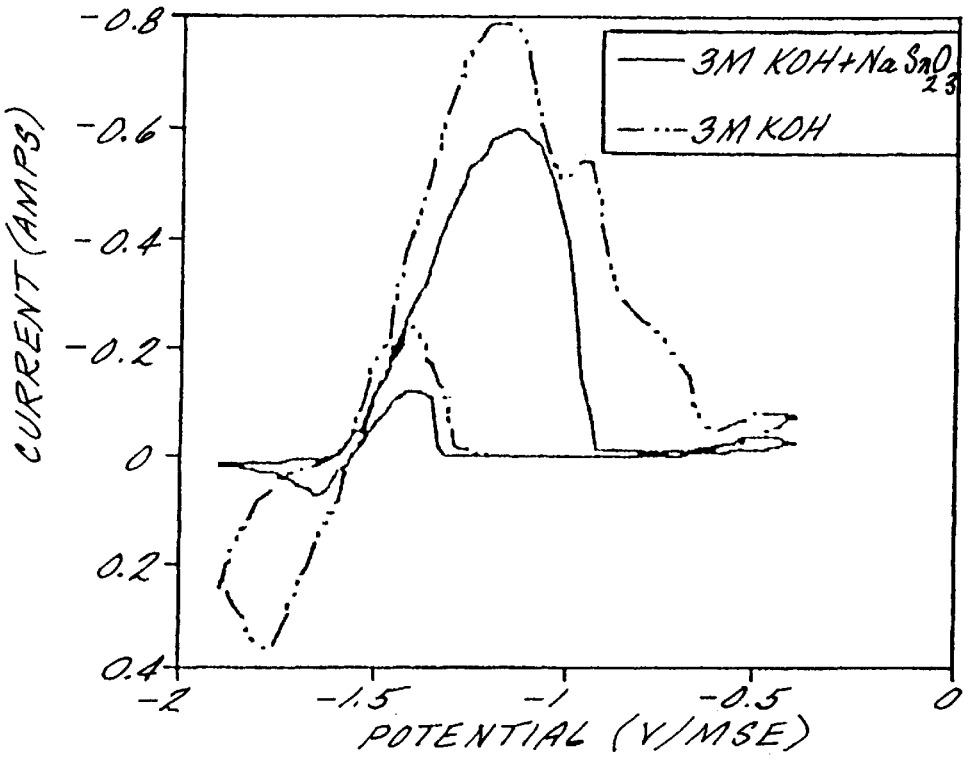
FIG. 6*a* illustrates the effect of tin ions in solution on the polarization behavior of tin plate at room temperature.
Figure 6B:
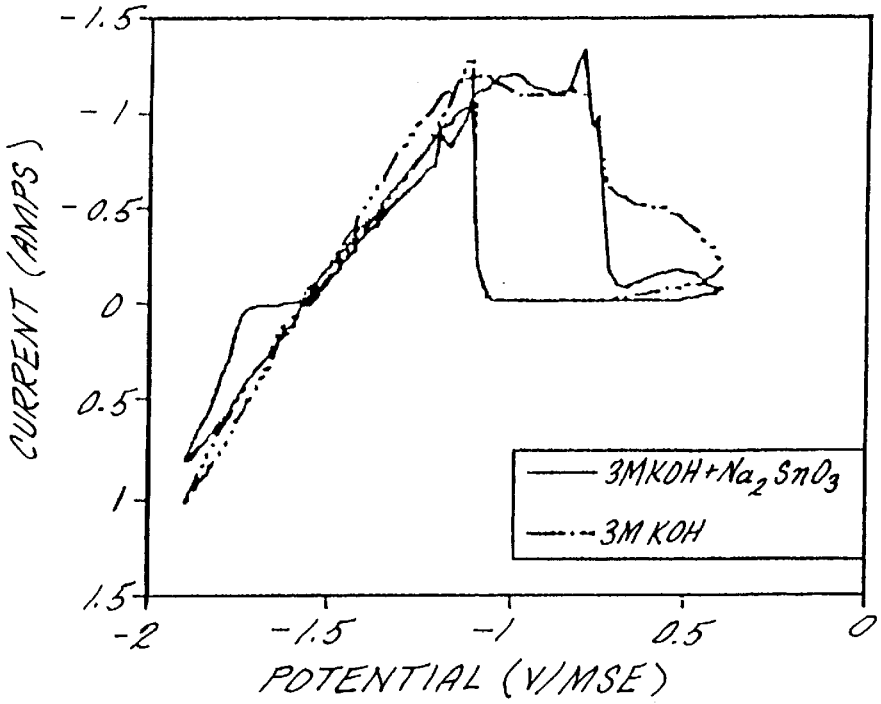
FIG. 6*b* illustrates the effect of tin ions in solution on the polarization behavior of tin plate at 50° C.
Figure 6C:
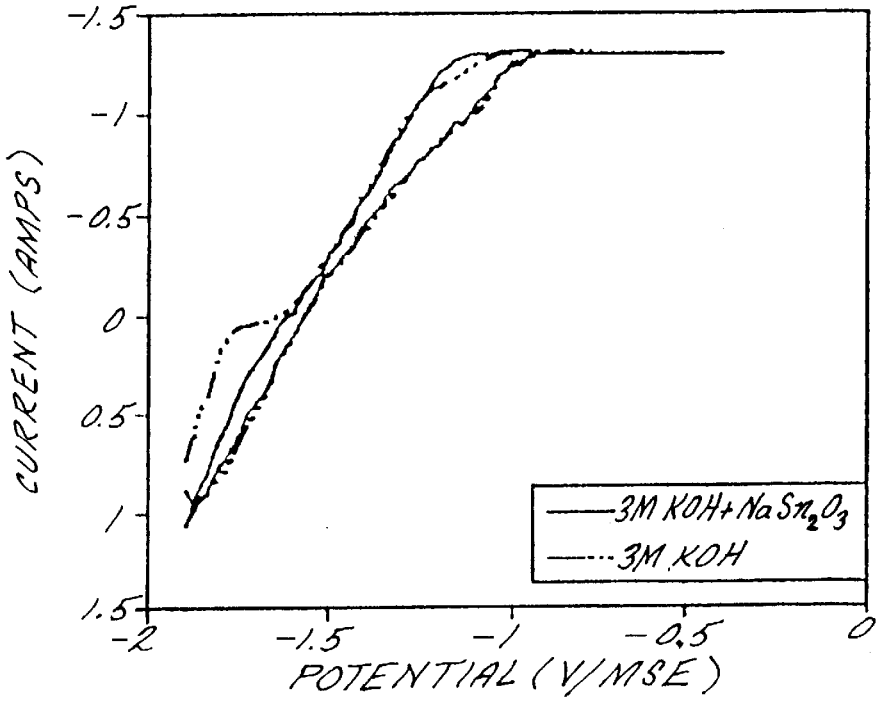
FIG. 6*c* illustrates the effect of tin ions in solution on the polarization behavior of tin plate at 80° C.

The effect of tin ions in solution on the detinning process was evaluated by measuring the polarization of tin plate in the presence of a tin salt (0.25 M $Na_2SnO_3$) in a 3.0 M KOH solution at 25°, 500° and 80° C. As shown in FIGS. 6A, 6B, and 6C, the presence of 0.25 M tin ions had no effect on the dissolution behavior of tin metal.

Example 6

The effect of KOH concentration in the residence time for the detinning process was evaluated by detinning under galvanostatic conditions at 0.3, 1.0, and 3.0 M KOH. At 0.3 M KOH, the removal of tin was incomplete.

Figure 7:
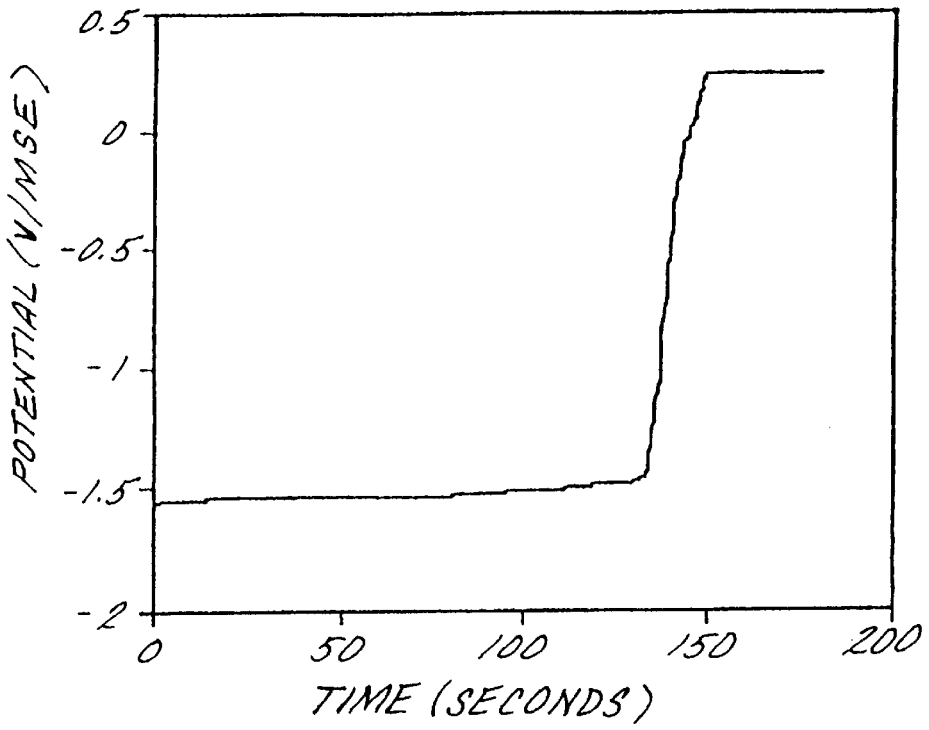
FIG. 7 illustrates the dissolution of tin from tin plate under galvanostatic conditions, 5 mA/cm$^2$, in 1.0 M KOH at room temperature.
Figure 8:
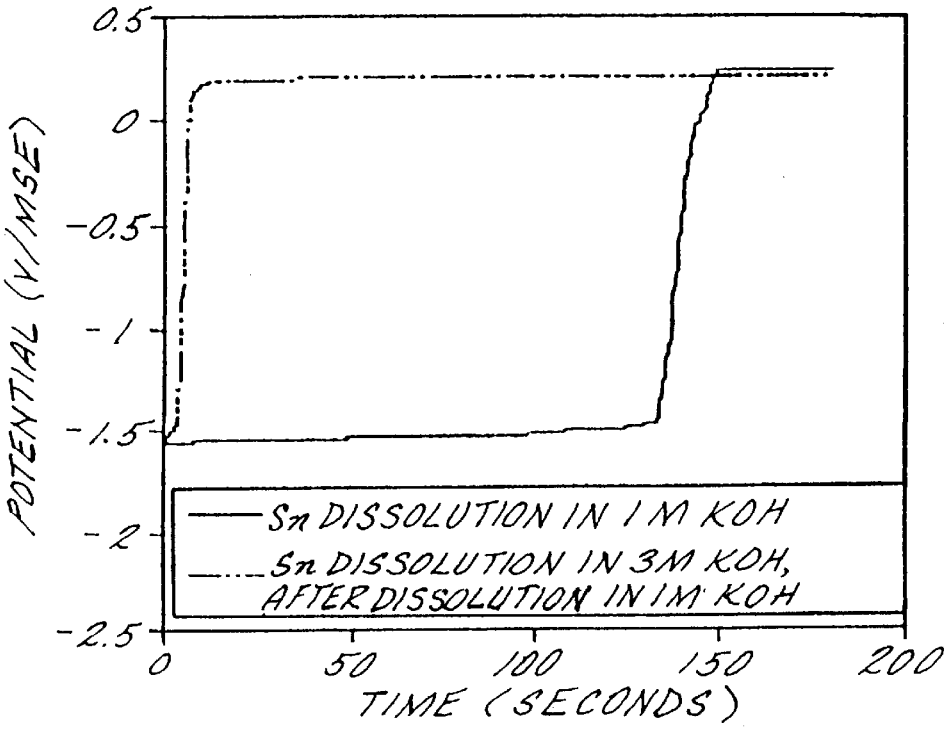
FIG. 8 illustrates detinning in 1.0 M KOH and subsequent treatment at 3.0 M KOH at 5 mA/cm$^2$.

At 1.0 M KOH, the residence time for detinning at room temperature at an applied current density of 5 mA/cm$^2$ was approximately 125 seconds, as shown in FIG. 7. To show that tin was completely removed, the anodic dissolution process was repeated in 3.0 M KOH. FIG. 8 clearly shows that no tin is present after anodic dissolution in 1.0 M KOH.

Figure 9:
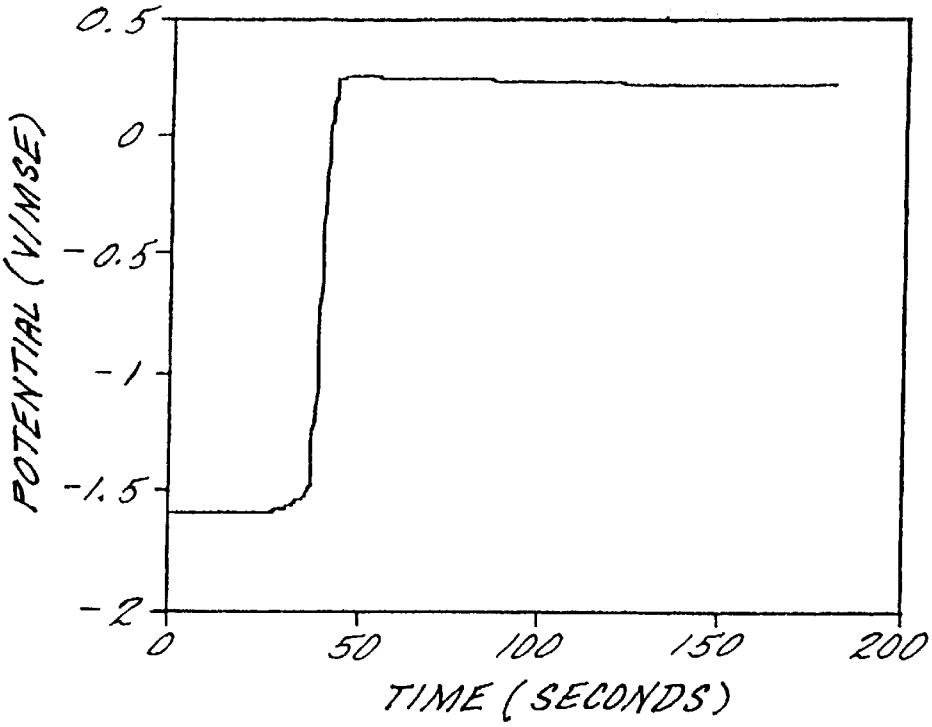
FIG. 9 illustrates the dissolution of tin from tin plate under galvanostatic conditions, 5 mA/cm$^2$, in 3.0 M KOH at room temperature.

At 3.0 M KOH, the residence time for tin removal at room temperature decreased by more than a factor of two to approximately 40 seconds as shown in FIG. 9.

Example 7

Figure 10:
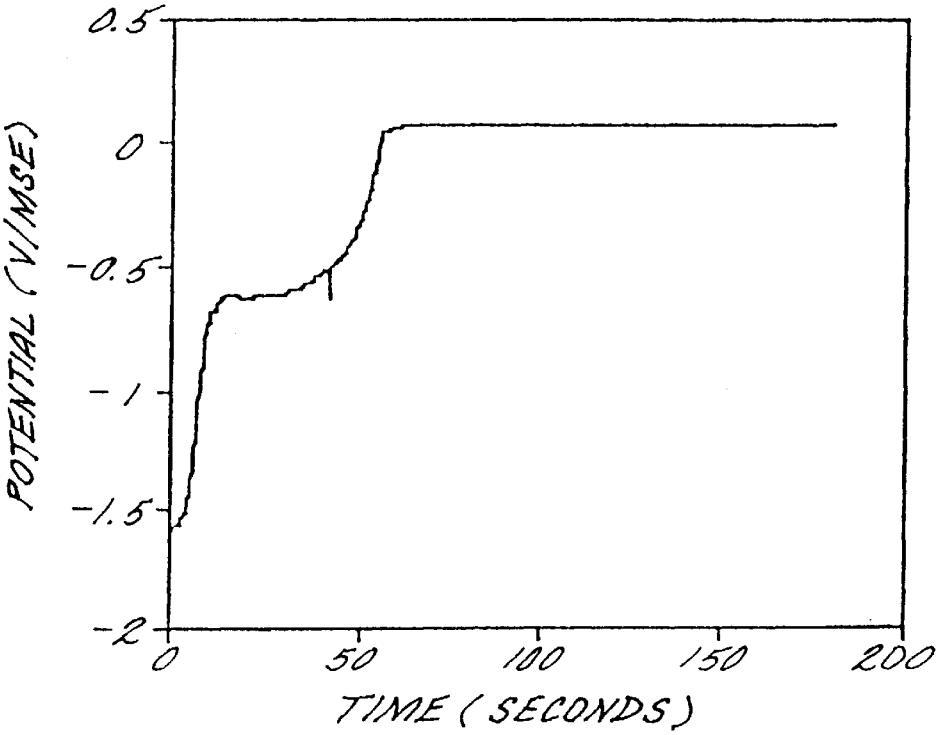
FIG. 10 illustrates the dissolution of tin from tin plate under galvanostatic conditions, 5 mA/cm$^2$, in 3.0 M KOH at 80° C.

The effect of temperature on the anodic dissolution of tin plate at 3.0 M KOH at an applied current density of 5 mA/cm$^2$. As shown in Example 7, the residence time for tin removal at room temperature is about 40 seconds. When the temperature is raised to 80° C., the tin dissolution behavior shows two regions characteristic of dissolution in acidic environments, free tin and tin alloy dissolution (FIG. 10).

Figure 11:
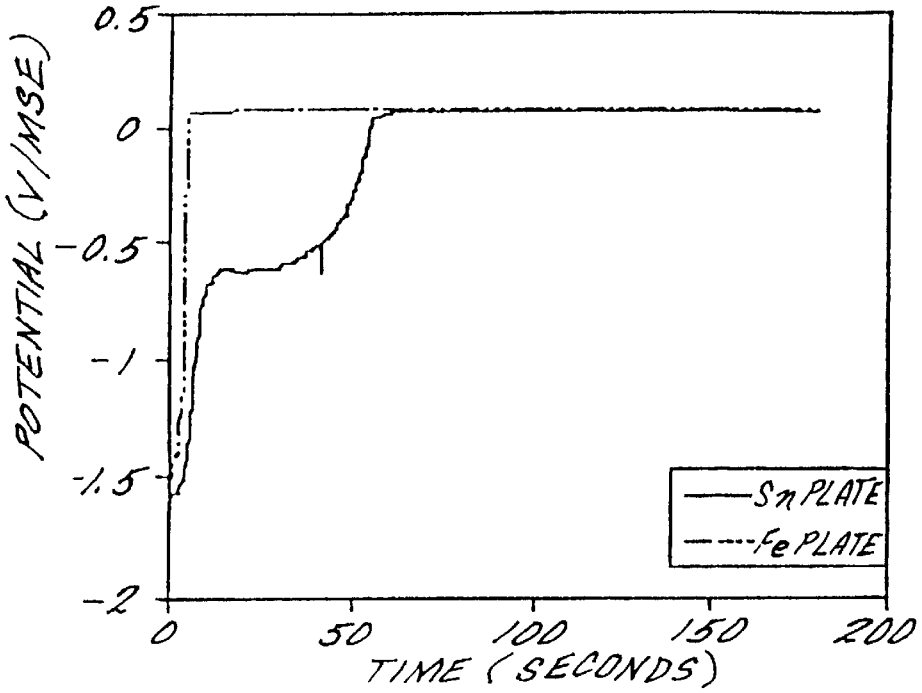
FIG. 11 illustrates the dissolution of tin and iron plate under galvanostatic conditions, 5 mA/cm$^2$, in 3.0 M KOH at 80° C.

The tin alloy dissolution results from the Tin—Fe alloyed region at the Tin—Fe interface. The dissolution behavior was further studied using iron plate for comparison. FIG. 11 shows the potential-time curves for tin-plated mild steel and an iron metal substrate in 3.0 M KOH at 80° C. and 5 mA/cm$^2$. After approximately 60 seconds, the potential for the tin-plated steel and iron metal substrate were the same, indicating that all of the tin had been removed. These results suggest that the complete removal of tin occurs under galvanostatic conditions in 3.0 M KOH at 80° C.

Example 8

Figure 12:
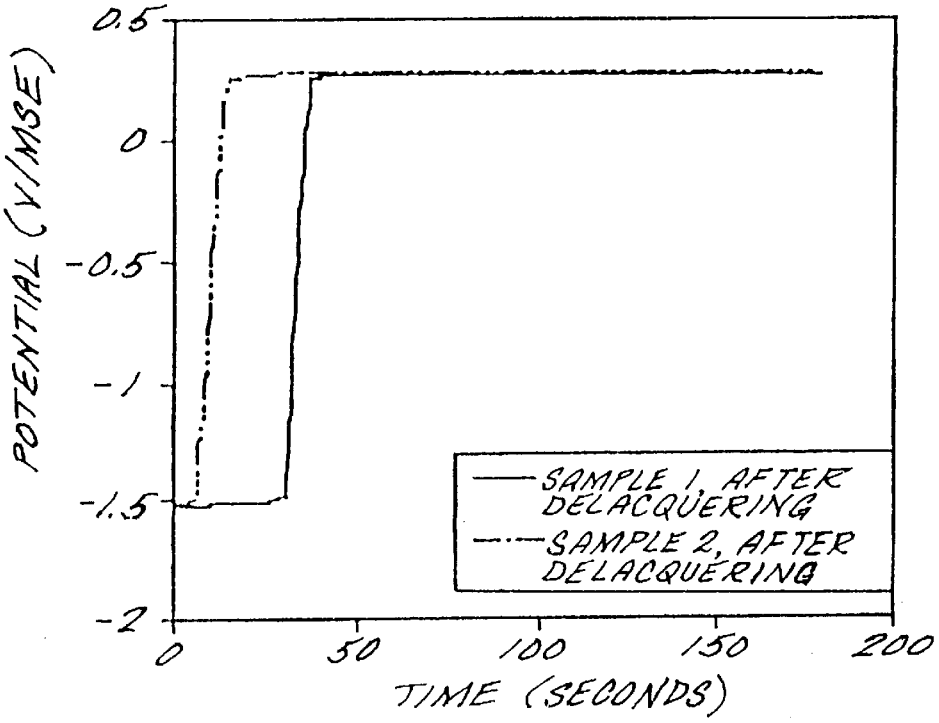
FIG. 12 illustrates the galvanostatic dissolution of tin from two different samples of tin cans in 1M KOH after lacquer removal at 5 mA/cm$^2$ at room temperature.

FIG. 12 shows the removal of tin (room temperature, 1.0 M KOH, 5 mA/cm$^2$) from tin samples derived from two different cans that had been previously delacquered. The fact that the residence time for the two samples were different indicating varying amounts of tin plate for different cans.

Example 9

The effect of the state of the lacquer coating on residence time was determined in an electrochemical cell. Tin cans were first separated into seven categories according to color and appearance of the lacquer, which were then further characterized according to form, i.e., flat and wrinkled. Three surface pretreatments were investigated, including smooth; abraded with a wire brush; and scratched with a stylus. The objective of abrading and scratching the surface was to increase the area available for hydrogen evolution thus facilitating the cathodic disbonding process, i.e., the removal of the lacquer coating. Delacquering of each of the types was carried out in 5 weight % sodium lauryl sulfate, 0.1 M potassium hydroxide, and 0.1 M potassium hydroxide plus 5 weight % Triton-100 at three current densities, 0.05, 0.1 and 0.2 A/cm$^2$. The results are presented in Table 3.

TABLE 3

| Lacquer Type | Solution | Temp. (° C.) | Surface | Current Density (A/cm$^2$) | Residence Time (sec.) |
|---|---|---|---|---|---|
| 1 | A | 80 | smooth | 0.05 | 26 |
| 1 | A | 80 | smooth | 0.1 | 20 |
| 1 | A | 80 | smooth | 0.2 | 20 |
| 2 | A | 80 | smooth | 0.05 | N/A |
| 2 | A | 80 | smooth | 0.1 | N/A |
| 2 | A | 80 | scratched | 0.2 | N/A |
| 3 | A | 80 | smooth | 0.1 | N/A |
| 3 | A | 80 | smooth | 0.2 | N/A |
| 3 | A | 80 | brushed | 0.2 | N/A |
| 4 | A | 80 | smooth | 0.2 | N/A |
| 4 | A | 80 | brushed | 0.2 | 50 |
| 4 | A | 80 | brushed | 0.1 | N/A |
| 5 | A | 80 | smooth | 0.1 | N/A |
| 5 | A | 80 | smooth | 0.2 | N/A |
| 5 | A | 80 | scratched | 0.2 | N/A |
| 2 | B | 80 | smooth | 0.2 | N/A |
| 2 | B | 80 | smooth | 0.2 | N/A |
| 3 | B | 80 | smooth | 0.2 | N/A |
| 3 | B | 80 | scratched | 0.2 | 60 |
| 3 | B | 80 | scratched | 0.1 | N/A |
| 4 | B | 80 | smooth | 0.2 | N/A |
| 5 | B | 80 | smooth | 0.2 | N/A |
| 5 | B | 80 | scratched | 0.2 | 60 |
| 2 | C | 80 | smooth | 0.2 | 300 |
| 2 | D | 80 | smooth | 0.2 | 60 |
| 2 | D | 80 | smooth | 0.1 | 60 |
| 2 | D | 80 | smooth | 0.05 | N/A |

*N/A The lacquer was till bonded to the tin can after the current was applied for 60 seconds. Therefore, no residence time was measured throughout the duration of the test.
**Solution A — 0.1 M KOH, Solution B — 0.1 M KOH plus 5 weight % Triton - 100; Solution C — 3.0 M KOH; Solution D — 3.0 M KOH plus 5 weight % sodium lauryl sulfate.

The results indicate that the lowest residence times were obtained using 5 weight % sodium lauryl sulfate at 80° C. Accordingly, delacquering of each of the types was further investigated in 5 weight % sodium lauryl sulfate at three current densities, 0.05, 0.1 and 0.2 A/cm$^2$. The results are presented in Table 4.

TABLE 4

| Lacquer Type | Temperature (° C.) | Surface | Current Density ($A/cm^2$) | Residence Time (sec.) |
|---|---|---|---|---|
| 1 | 80 | smooth | 0.1 | 60 |
| 1 | 80 | smooth | 0.05 | 80 |
| 1 | 80 | wrinkled | 0.05 | 80 |
| 2 | 80 | smooth | 0.05 | N/A |
| 2 | 80 | scratched | 0.05 | N/A |
| 2 | 80 | smooth | 0.1 | N/A |
| 3 | 80 | smooth | 0.05 | N/A |
| 3 | 80 | scratched | 0.05 | N/A |
| 4 | 80 | smooth | 0.05 | N/A |
| 4 | 80 | scratched | 0.05 | 60 |
| 5 | 80 | smooth | 0.05 | N/A |
| 5 | 80 | scratched | 0.05 | 120 |
| 6 | 80 | smooth | 0.05 | N/A |
| 6 | 80 | scratched | 0.05 | 60 |
| 7 | 80 | smooth | 0.05 | N/A |
| 7 | 80 | scratched | 0.05 | 60 |

*N/A — The lacquer was till bonded to the tin can after the current was applied for 60 seconds. Therefore, no residence time was measured throughout the duration of the test.

Figure 15:
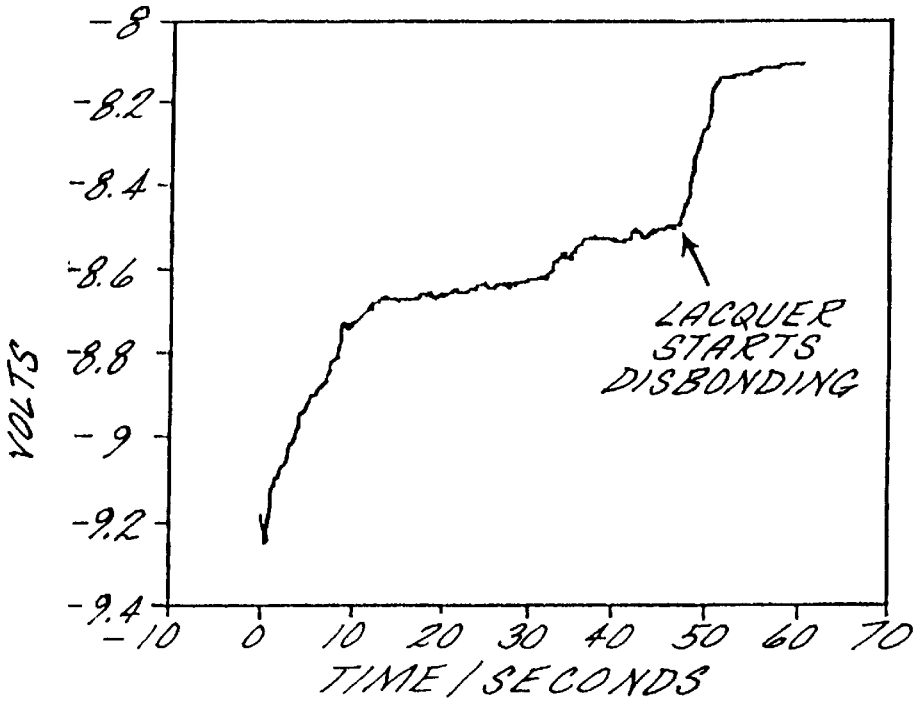
FIG. 15 illustrates the potential-time curve for lacquer removal in 5 weight % sodium lauryl sulfate at 80° C. at an applied current density of 0.1 A/cm$^2$.

The results from this study show that not all lacquer coatings could be removed using 5 weight % sodium lauryl sulfate as the surfactant. The potential time curve for the lacquer process is presented in FIG. 15, wherein the time required for the potential decay is a measure of the residence time. The rapid decay shown in FIG. 15 indicates that the lacquer coating has become disbanded.

Example 10

Figure 16:
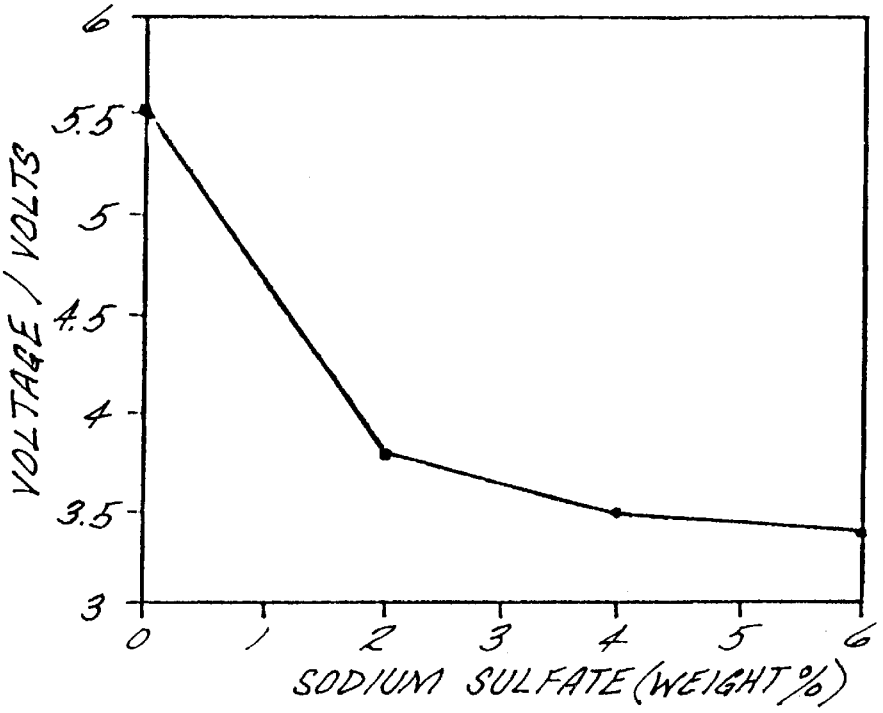
FIG. 16 illustrates the effect of sodium sulfate on the voltage for the delacquer process.

Electrochemical studies were carried out to determine the effect of sodium sulfate and potassium nitrite as supporting electrolytes. The addition of supporting electrolyte to the lacquer removal bath lowers the voltage needed for a given current, thus lowering the power requirement. The addition of potassium nitrite was found to depolarize the evolution of hydrogen and oxygen resulting in lower current efficiencies. Sodium sulfate was found to lower the voltage with increasing concentration as shown in FIG. 16. The voltage was measured at a current density of 0.05 $A/cm^2$. The addition of 6 weight % sodium sulfate to 5 weight % sodium lauryl sulfate lowers the voltage by approximately 2 volts.

Example 11

Figure 19:
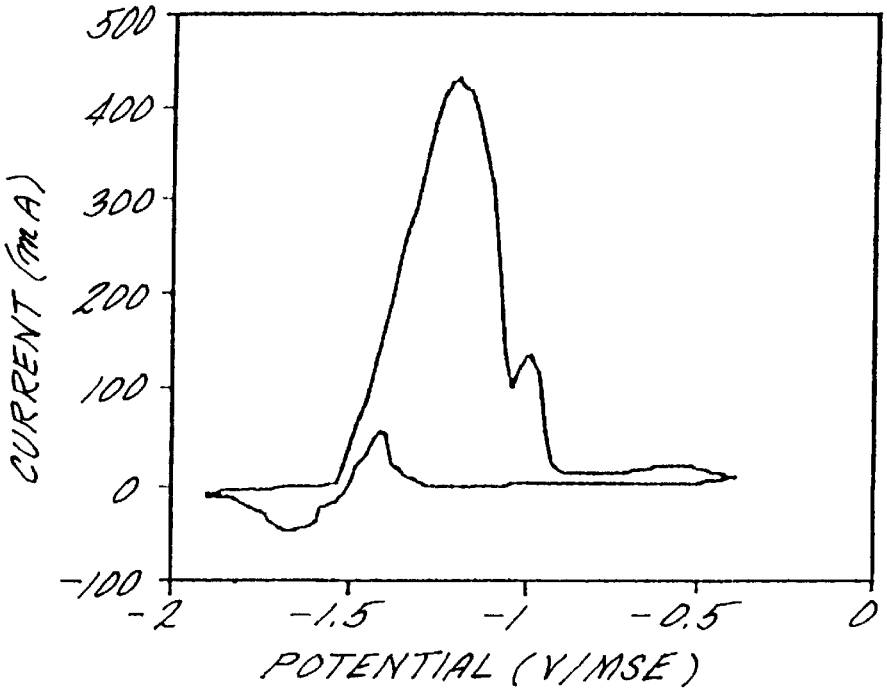
FIG. 19 illustrates the polarization curve of pure tin in 3.0 M KOH at room temperature.
Figure 20:
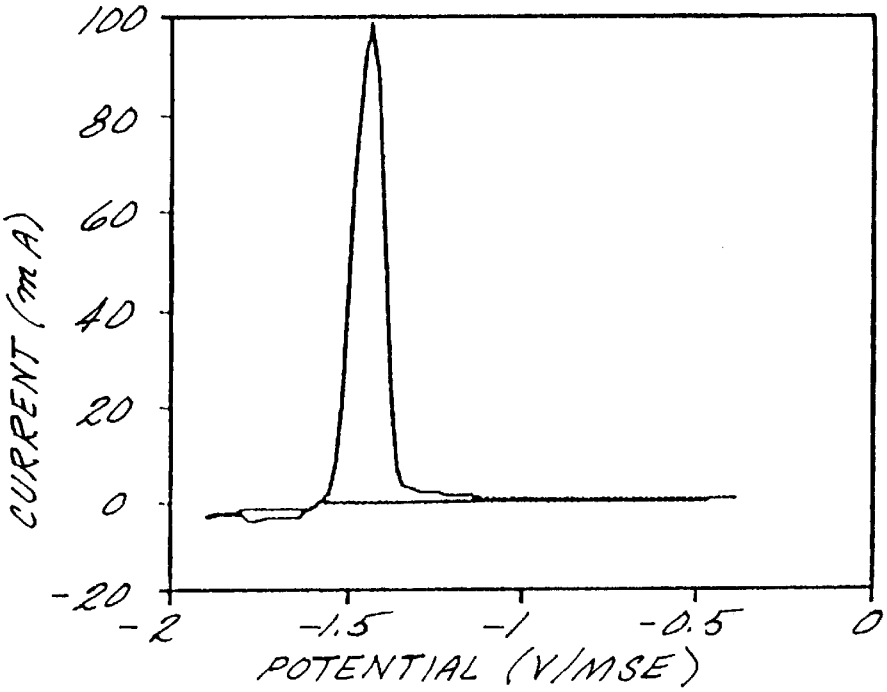
FIG. 20 illustrates the polarization curve of tin plate on mild steel (tin can) in 3.0 M KOH at room temperature.
Figure 21:
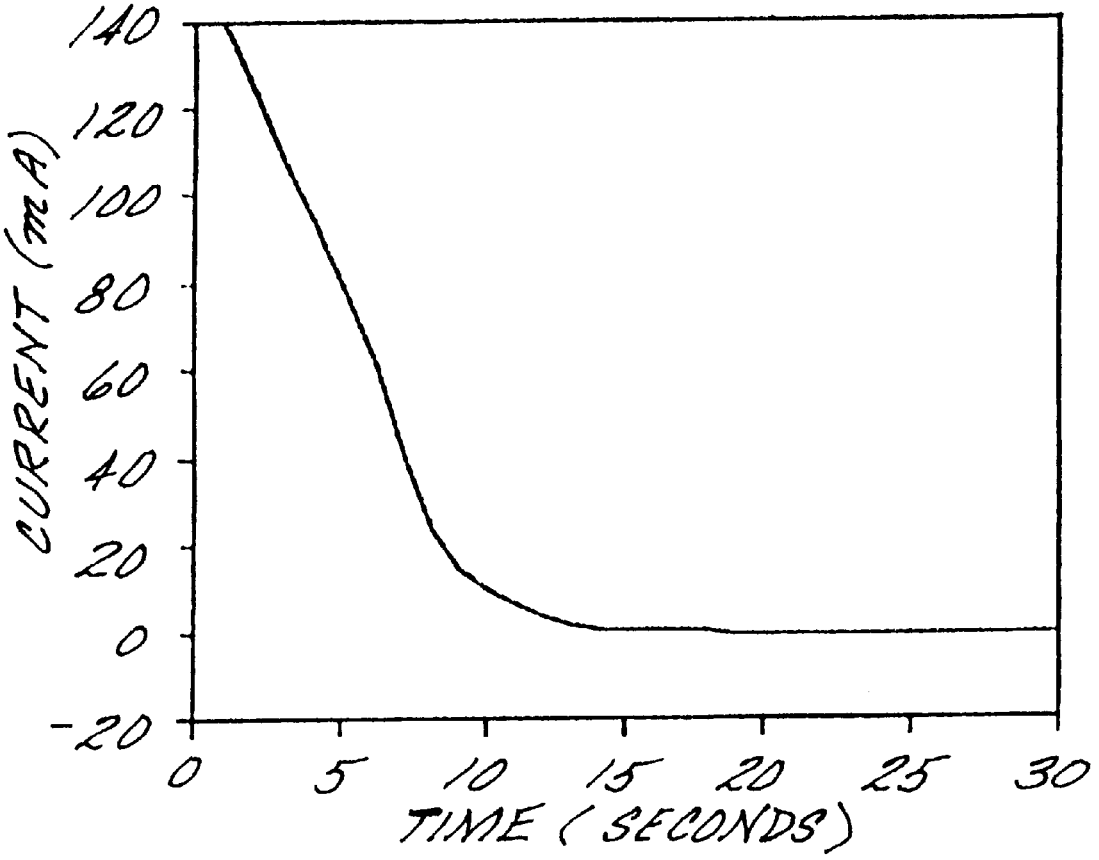
FIG. 21 illustrates Sn dissolution at −1.4 V of tin plate on mild steel (tin can) in 3.0 M KOH at room temperature.

Electrochemical studies were carried out using 3.0 M KOH at room temperature. FIG. 19 shows the anodic polarization curve for pure tin. The scan rate was 20 mV/sec and the potentials were measured against a mercurous sulfate reference electrode (MSE). For pure tin, dissolution starts at −1.54 V and reaches a maximum at −1.2 V. At higher potentials, the current decays due to the formation of tin oxide. FIG. 20 shows the polarization curve for a tin plated steel can in the same solution. Tin dissolution starts at −1.6 V and terminates at −1.34 V. The maximum dissolution rate occurs at −1.4 V. The activation potentials for pure tin and tin plate are similar; however, the rate of tin dissolution decays more rapidly for tin plate. If the potential is held at −1.4 V, it takes 15 seconds to completely remove tin from the surface of the can, FIG. 21. The scan rate for the polarization studies was 20 mV/sec. Thus, the time required to scan from −1.6 to −1.34 V is 13 seconds. It is apparent from FIG. 21 that most of the tin is removed after 13 seconds. This explains why the current decays rapidly during the polarization measurement of tin plate, FIG. 20.

Example 12

Electrochemical studies were carried out to evaluate the use of SP-76 as the electrolyte for the delacquering process. Delacquering experiments were carried out with 3 weight % SP-76 (4 oz/gal), and 3 weight % SP-138, and mixtures containing SP-76, SP-138, $Na_2SO_4$ and SLS. The effect of temperature, current density and delacquering time on lacquer removal was also investigated. The lacquer removal studies were carried out on cans with different types of lacquers (Numbered 1 through 8 depending upon the color of the lacquer shown in Table 5). The effectiveness of lacquer removal was quantified by determining the percentage of lacquer which has been removed based on visual observation.

The lacquer removal using different electrolytes are summarized in Tables 5 through 12. The observations for the different new systems considered indicate that SP-76 is very effective in comparison to all other solutions considered, and the rate of lacquer removal improves with increasing current density and temperature. Increasing the delacquering time increases the % lacquer removal. As is seen in Table 8 and Table 10, the temperature seems to be a crucial parameter. Above 85° C. most lacquers are removed using small amounts of current. It is believed the temperature enhances the wetting by making the polymeric material of the lacquer swell. Some lacquers dissolve in the electrolyte under these conditions. For some lacquers as with can type 3 and can type 5, the wetting starts from the edge of the sample and moves to the center and is very slow. Longer times have therefore removed more lacquer. Smaller pieces and scratching will reduce the delacquering time as had been mentioned in the first report.

Different electrolytes mixtures were prepared and delacquering was studied in order to improve the conductivity of the solutions while keeping the pH of the solution lower. There was some reduction in the lacquer removal efficiency with the addition of electrolytes to SP-76 as is seen from the Tables 8, 9 and 10. But this effect is much smaller than the effect of temperature.

Variations in the lacquer removal has been observed for samples from the same can under similar conditions. This could be an effect of the place from which the piece is cut from a can. There could be variations in the lacquer baking temperature in different parts of the cans, which can affect the wetting of the metal under the lacquered surface.

TABLE 5

| Can Type | Can appearance | Lacquer appearance |
|---|---|---|
| 1 | 2 piece can of size 3" Diameter. × 4.4" Height | Deep (darker) gold colored lacquer |
| 2 | 2 piece can of size | Pale white colored rubbery lacquer |
| 3 & 5 | 2 piece can of size 3.4" D × 4.4" H | Dull gold colored lacquer |

TABLE 5-continued

| Can Type | Can appearance | Lacquer appearance |
|---|---|---|
| 4 | 3 piece can of size 4.2" D × 7" H | Shiny light gold colored lacquer |
| 6 | 3 piece can of size 3" D × 4.4" H | Brownish yellow colored (has zinc in it) |
| 7 | 3 piece can ofsize 3" D × 4.4" H | Shiny gold colored lacquer |
| 8 (Pizza sauce can) | 3 piece can ofsize 6.2" D × 8" H | Gold colored lacquer with a greenish tinge |
| white can | 2 piece can of size 3" D × 4.4" H | White colored lacquer |
| Jonathan can | 3 piece can of size 5" D × 5" H | Gray colored lacquer |
| Light gold color lacquer can | 3 piece can of size 3" D × 4.4" H | Dull light gold colored lacquer |

TABLE 6

SP-138 — 60 g/l (8 oz/gal)

| Can type | Temperature | Current Density | Delacquering time | Lacquer Removal |
|---|---|---|---|---|
| Can2 | 76° C. | 50 mA/cm$^2$ | 1 minute | 60% |
| | 72° C. | 50 mA/cm$^2$ | 1 minute | 0% |
| | 72° C. | 50 mA/cm$^2$ | 1 minute | 30% |
| Can3 | 78° C. | 50 mA/cm$^2$ | 1 minute | Edge Removed |
| | 76° C. | 50 mA/cm$^2$ | 1 minute | Edge Removed |
| | 70° C. | 50 mA/cm$^2$ | 1 minute | Edge Removed |
| | 85° C. | 50 mA/cm$^2$ | 1 minute | Edge Removed |
| Can8 | 73° C. | 50 mA/cm$^2$ | 1 minute | 90% |
| | 81° C. | 50 mA/cm$^2$ | 1 minute | 80% |

TABLE 7

SP-138 — 30 g/l (4 oz/gal), SP-76 — 15 g/l

| Can type | Temperature | Current Density | Delacquering time | Lacquer Removal |
|---|---|---|---|---|
| Can2 | 77° C. | 50 mA/cm$^2$ | 1 minute | 100% |
| Can4 | 77° C. | 50 mA/cm$^2$ | 1 minute | 90% |
| Can5 | 77° C. | 50 mA/cm$^2$ | 1 minute | Edge Removed |
| Can7 | 77° C. | 50 mA/cm$^2$ | 1 minute | 100% |
| Can8 | 77° C. | 50 mA/cm$^2$ | 1 minute | 70% |

TABLE 8

SP-76 (3 wt %) — 30 g/l

| Can type | Temp-erature | Current Density | Delacquering time | Lacquer Removal | Cell Voltage |
|---|---|---|---|---|---|
| Can2 | 86° C. | 25 mA/cm$^2$ | 1 minute | 100% | |
| | 84° C. | 10 mA/cm$^2$ | 1 minute | 0% | |
| | 86° C. | 10 mA/cm$^2$ | 1 minute | 100% | V |
| | 86° C. | 10 mA/cm$^2$ | 1 minute | 85% | 0.7 V |
| Can3 | 85° C. | 50 mA/cm$^2$ | 1 minute | Edge Removed | |
| | 85° C. | 25 mA/cm$^2$ | 1 minute | Edge Removed | |
| | 85° C. | 10 mA/cm$^2$ | 1 minute | Edge Removed | |
| Can8 | 75° C. | 50 mA/cm$^2$ | 1 minute | 25% | 2.3 |
| | 78° C. | 50 mA/cm$^2$ | 1 minute | 60% | 2.35 |
| | 82° C. | 50 mA/cm$^2$ | 1 minute | 70% | 2.4 |
| | 82° C. | 50 mA/cm$^2$ | 1 minute | 100% | 2.4 |
| | 85° C. | 50 mA/cm$^2$ | 1 minute | 100% | 2.4 |
| | 86° C. | 50 mA/cm$^2$ | 1 minute | 100% | 2.0 |
| | 86° C. | 25 mA/cm$^2$ | 1 minute | 90% | |
| | 86° C. | 10 mA/cm$^2$ | 1 minute | 100% | |

TABLE 9

3% SP-76, 6% SP-138, 12% $Na_2SO_4$ and 0.75% Sodium Lauryl Sulfate

| Can type | Temp-erature | Current Density | Delacquering time | Lacquer Removal | Cell Voltage |
|---|---|---|---|---|---|
| Can2 | 86° C. | 5 mA/cm$^2$ | 2 minute | 100% | |
| | 87° C. | 5 mA/cm$^2$ | 2 minute | 90% | |
| | 85° C. | 1 mA/cm$^2$ | 1 minute | 20% | V |
| | 85° C. | 1 mA/cm$^2$ | 2 minute | 10% | 0.300 V |
| Can3 | 85° C. | 1 mA/cm$^2$ | 1 minute | Edge Removed | |
| | 85° C. | 1 mA/cm$^2$ | 2 minute | Edge Removed | |
| Can4 | 85° C. | 5 mA/cm$^2$ | 2 minute | Edge Removed | |
| | 85° C. | 5 mA/cm$^2$ | 2 minute | Edge Remdved | |
| | 85° C. | 10 mA/cm$^2$ | 2 minute | 50% | |
| | 85° C. | 10 mA/cm$^2$ | 2 minute | 40% | |
| Can6 | 85° C. | 5 mA/cm$^2$ | 2 minute | 100% | 0.330 V |
| Can8 | 85° C. | 50 mA/cm$^2$ | 1 minute | 100% | |
| | 85° C. | 50 mA/cm$^2$ | 1 minute | 90% | |
| | 85° C. | 25 mA/cm$^2$ | 1 minute | 85% | V |
| | 85° C. | 25 mA/cm$^2$ | 1 minute | 100% | 0.580 V |
| | 87° C. | 10 mA/cm$^2$ | 1 minute | 85% | V |
| | 86° C. | 5 mA/cm$^2$ | 1 minute | 80% | 0.350 V |
| | 86° C. | 0 mA/cm$^2$ | 1 minute | 20% | |
| | 86° C. | 0 mA/cm$^2$ | 2 minute | 100% | |

TABLE 10

% SP-76, 6% SP-138, 12% $Na_2SO_4$ and 0.75% Sodium Lauryl Sulfate

| Can type | Temperature | Current Density | Delacquering time | Lacquer Removal |
|---|---|---|---|---|
| Can2 | 74° C. | 50 mA/cm$^2$ | 1 minute | 30% |
| Can8 | 75° C. | 50 mA/cm$^2$ | 1 minute | 20% |
| | 74° C. | 50 mA/cm$^2$ | 1 minute | 60% |
| Can2 | 80° C. | 50 mA/cm$^2$ | 1 minute | 100% |
| | 80° C. | 50 mA/cm$^2$ | 1 minute | 100% |
| | 80° C. | 10 mA/cm$^2$ | 1 minute | 100% |
| Can3 | 78° C. | 50 mA/cm$^2$ | 1 minute | Edge Removed |
| Can8 | 80° C. | 50 mA/cm$^2$ | 1 minute | 50% |
| | 80° C. | 50 mA/cm$^2$ | 1 minute | 40% |
| | 80° C. | 50 mA/cm$^2$ | 1 minute | 60% |
| | 80° C. | 50 mA/cm$^2$ | 1 minute | 40% |
| Can2 | 86° C. | 10 mA/cm$^2$ | 1 minute | 100% |
| | 85° C. | 5 mA/cm$^2$ | 1 minute | 70% |
| Can3 | 85° C. | 50 mA/cm$^2$ | 2 minute | 40% |
| Can5 | 85° C. | 50 mA/cm$^2$ | 1 minute | Edge Removed |
| | 85° C. | 100 mA/cm$^2$ | 1 minute | 20% |
| Can8 | 85° C. | 50 mA/cm$^2$ | 1 minute | 100% |
| | 85° C. | 50 mA/cm$^2$ | 1 minute | 100% |
| | 85° C. | 25 mA/cm$^2$ | 1 minute | 60% |
| Can3 | 88° C. | 50 mA/cm$^2$ | 1 minute | Edge Removed |
| Can5 | 88° C. | 50 mA/cm$^2$ | 1 minute | Edge Removed |
| Can8 | 88° C. | 25 mA/cm$^2$ | 1 minute | 100% |

TABLE 11

SP-76 — 30 g/l (4 oz/gal)

| Can type | Temperature | Current Density | Delacquering time | Lacquer Removal |
|---|---|---|---|---|
| Can2 | 80° C. | 50 mA/cm$^2$ | 1 minute | 100% |
| | 80° C. | 25 mA/cm$^2$ | 1 minute | 70% |
| | 80° C. | 10 mA/cm$^2$ | 1 minute | 70% |
| Can3 | 80° C. | 50 mA/cm$^2$ | 1 minute | Edge Removed |
| | 80° C. | 50 mA/cm$^2$ | 1 minute | Edge Removed |
| | 80° C. | 50 mA/cm$^2$ | 5 minute | 40% |
| | 80° C. | 50 mA/cm$^2$ | 10 minute | 40% |
| Can8 | 80° C. | 50 mA/cm$^2$ | 1 minute | 100% |
| | 80° C. | 50 mA/cm$^2$ | 1 minute | 80% |
| | 80° C. | 50 mA/cm$^2$ | 1 minute | 60% |

TABLE 12

3% SP-76, 2% Sodium Lauryl Sulfate

| Can type | Temperature | Current Density | Delacquering time | Lacquer Removal |
|---|---|---|---|---|
| Can2 | 80° C. | 50 mA/cm$^2$ | 1 minute | 90% |
| Can3 | 80° C. | 50 mA/cm$^2$ | 1 minute | Edge Removed |

TABLE 13

3% SP-76, 2% SP-138

| Can type | Temperature | Current Density | Delacquering time | Lacquer Removal |
|---|---|---|---|---|
| Can2 | 80° C. | 50 mA/cm$^2$ | 1 minute | 50% |
| Can3 | 80° C. | 50 mA/cm$^2$ | 1 minute | Edge Removed |
| | 80° C. | 50 mA/cm$^2$ | 10 minute | 70% |
| Can8 | 80° C. | 50 mA/cm$^2$ | 1 minute | 80% |

The conductivity of the delacquering solutions is obtained by measuring the solution resistance between electrodes of area 1 cm$^2$ separated by a distance of 3 cm using impedance spectroscopy. The conductivities of the different delacquering solutions were measured and compared with 12 weight % SP-76. This is summarized in Table 14. The conductivity of SP-76 is much higher than the other electrolytes added to it.

TABLE 14

| Electrolyte | Temperature | Resistance | Conductivity |
|---|---|---|---|
| 12% SP-76 (16 oz/gal) | 19° C. | 2.5 W | 1.2 W$^{-1}$cm$^{-1}$ |
| | 72° C. | 1.26 W | 2.38 W$^{-1}$cm$^{-1}$ |
| 3% SP-76 (4 oz/gal), 10% $Na_2SO_4$ | 19° C. | 7.8 W | 0.384 W$^{-1}$cm$^{-1}$ |
| 3% SP-76 (4 oz/gal), 10% $Na_2SO_4$ | 19° C. | 5.5 W | 0.545 W$^{-1}$cm$^{-1}$ |
| | 72° C. | 1.8 W | 1.2 W$^{-1}$cm$^{-1}$ |
| 3% SP-76, 10% $Na_2SO_4$ | 72° C. | 1.59 W | 1.67 W$^{-1}$cm$^{-1}$ |
| 3% SP-76, 6% SP-138, 10% $Na_2SO_4$, 0.75% Sodium Lauryl Sulfate | 60° C. | 2.2 W | 1.36 W$^{-1}$cm$^{-1}$ |
| | 74° C. | 1.7 W | 1.76 W$^{-1}$cm$^{-1}$ |

Example 13

Figure 22:
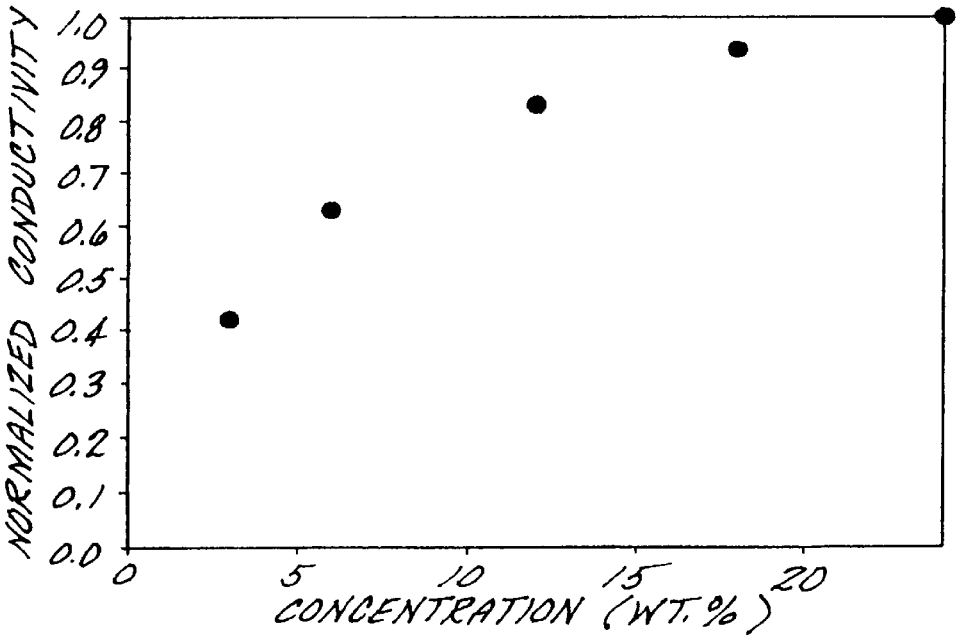
FIG. 22 illustrates the normalized conductivity of SP-76 at 88° C.

The normalized conductivity of SP-76 at 88° C. is shown in FIG. 22. Normalized conductivity was obtained by measuring the solution resistance, the reciprocal of conductivity between platinum electrodes of area 8 cm$^2$ separated by a distance of 3.5 cm using AC impedance. Since the cell-constant for this cell system is not known, the values measured by the AC impedance technique are in units of ohms$^{-1}$ rather than (ohms-cm)$^{-1}$ which are the correct units of conductivity. Rather than calibrate the distance between electrodes empirically, the same exact experimental setup was used, so while the cell constant is not known its value is the same for each measurement. FIG. 22 shows the conductivity increases rapidly with increasing concentration of SP-76 at low concentrations and then levels off. Since the conductivity of SP-76 does not appreciably increase while the concentration increases from 18% to 24% the preferred operating concentration of SP-76 IS 18%. SP-76 phase separates at 24 wt. % which also makes higher concentrations undesirable.

The pH was measured by determining the hydroxyl ion ($OH^-$) concentration by volumetric titrations with a standard acid solution for SP-76 solutions for two different concentrations, 3 wt. % and 24 wt. %. $OH^-$ concentrations were proportional to the SP-76 concentration as expected. From these values the $OH^-$ concentration and pH were calculated for different SP-76 concentrations. The pH values as determined from these measurements and calculations are summarized in Table 15 below.

TABLE 15

| SP-76, Concentration | OH Concentration | pH |
|---|---|---|
| 3 wt. % | 0.57 N | 13.8 |
| 6 wt. % | 1.15 N | 14.1 |
| 9 wt. % | 1.72 N | 14.2 |
| 12 wt. % | 2.30 N | 14.4 |
| 15 wt. % | 2.87 N | 14.5 |
| 18 wt. % | 3.44 N | 14.5 |
| 21 wt. % | 4.02 N | 14.6 |
| 24 wt. % | 4.57 N | 14.7 |

Example 14

Figure 23:
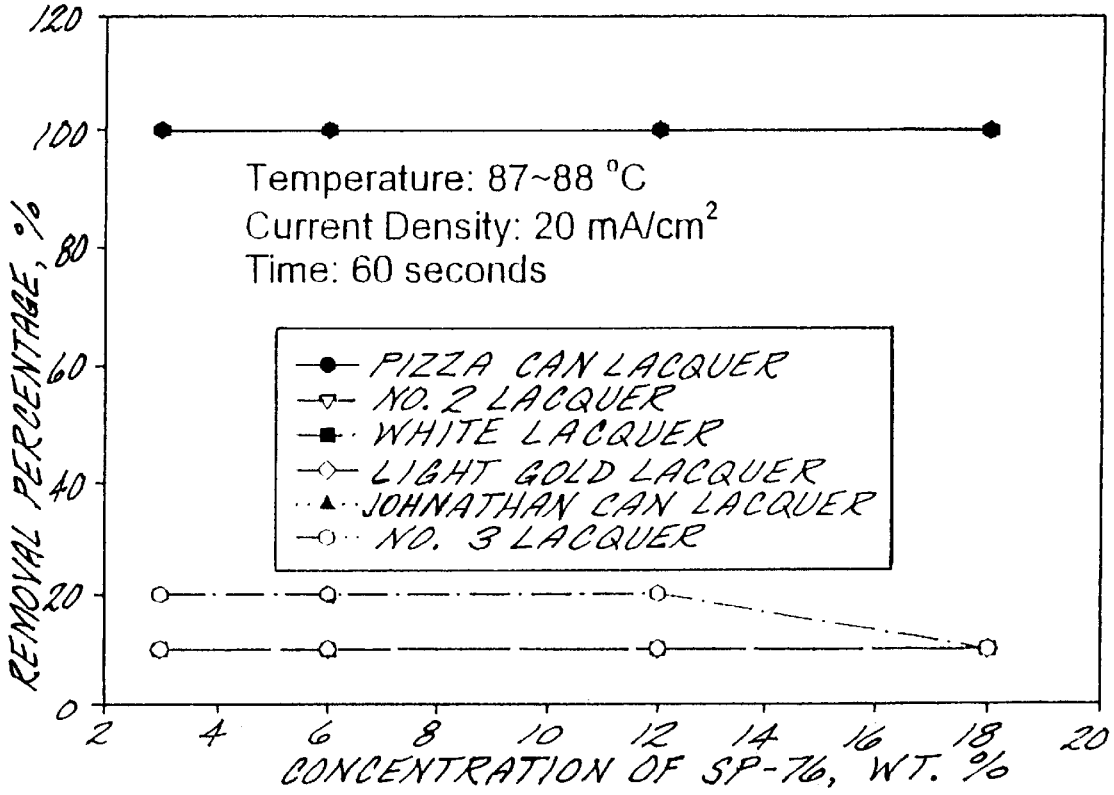
FIG. 23 illustrates the effect of the concentration of SP-76 on the lacquer removal for different lacquers.

The effect of SP-76 concentration on lacquer removal for six different lacquers was evaluated and the results are shown in FIG. 23. The experiments were performed in a beaker at 190° F. (88° C.) with an applied current density of 20 mA/cm$^2$ for 60 seconds with no convection. The percent removal of lacquer was calculated by the following equation, wherein the $$\text{Percent removal} = (100)\frac{(1 - \text{lacquer area after delacquering})}{(\text{lacquer area before delacquering})}$$

Where the area after delacquering was measured as that exposed area after gently peeling back the wet lacquer with a tweezer. The force applied by the tweezer is much less than that expected to occur by mechanical tumbling and pressure spray in the actual process. The error in determining the delacquered area is +/−5% passed on the observations for 4 people examining each tin can fragment and in comparison with multiple fragments. For concentrations in the range of 3% to 18% (wt.), all lacquers show little change in removal percentage so lacquer removal is independent of SP-76 concentration.

Example 15

Figure 24:
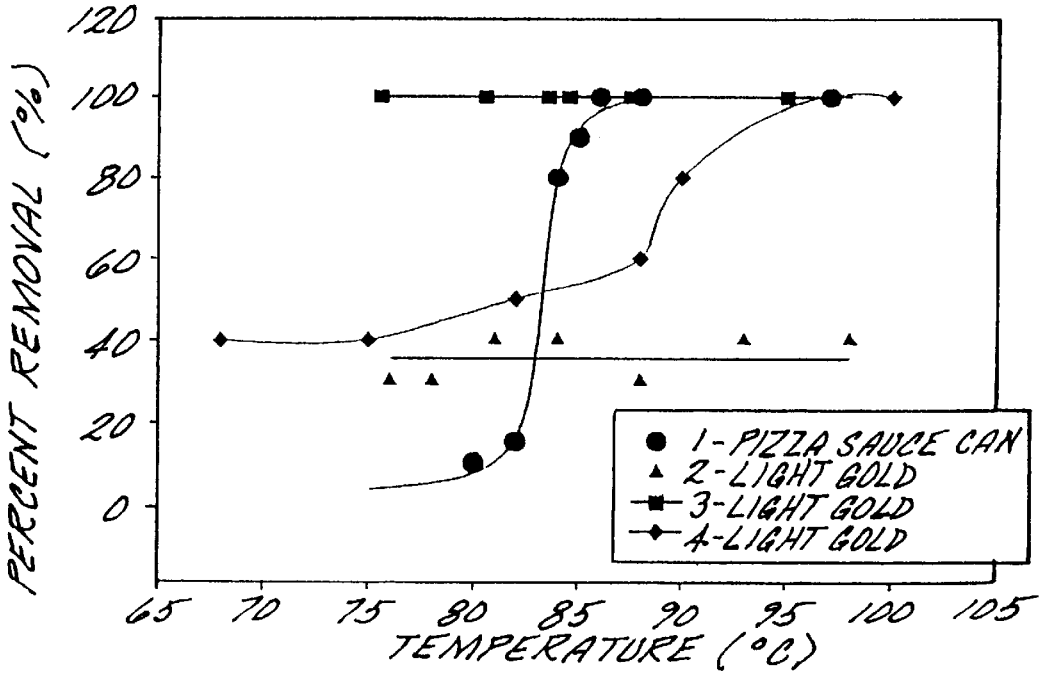
FIG. 24 illustrates the effect of temperature on lacquer removal using 18% SP-76 (1—pizza sauce can: 30 seconds, 20 mA/cm$^2$; 2—light gold lacquer: 20 mA/cm$^2$, 60 seconds 3—light gold lacquer: 40 mA/cm$^2$, 120 seconds)

The effect of temperature on lacquer removal is shown in FIG. 24. The temperature has a strong effect on pizza sauce lacquer removal, but has little effect on the removal of light gold lacquer. For pizza sauce can lacquer, removal percentage increases from 15% to 100% when temperature increases from 82° C. to 86° C. However, there is little change of removal percentage for light gold lacquer for the same temperature change. However, the light gold lacquer shows a strong temperature dependence for a residence time of 2 minutes. This indicates that for this type of lacquer wetting controls the lacquer removal and a longer residence time provides for better wetting of the lacquer metal interface.

Example 16

Figure 25:
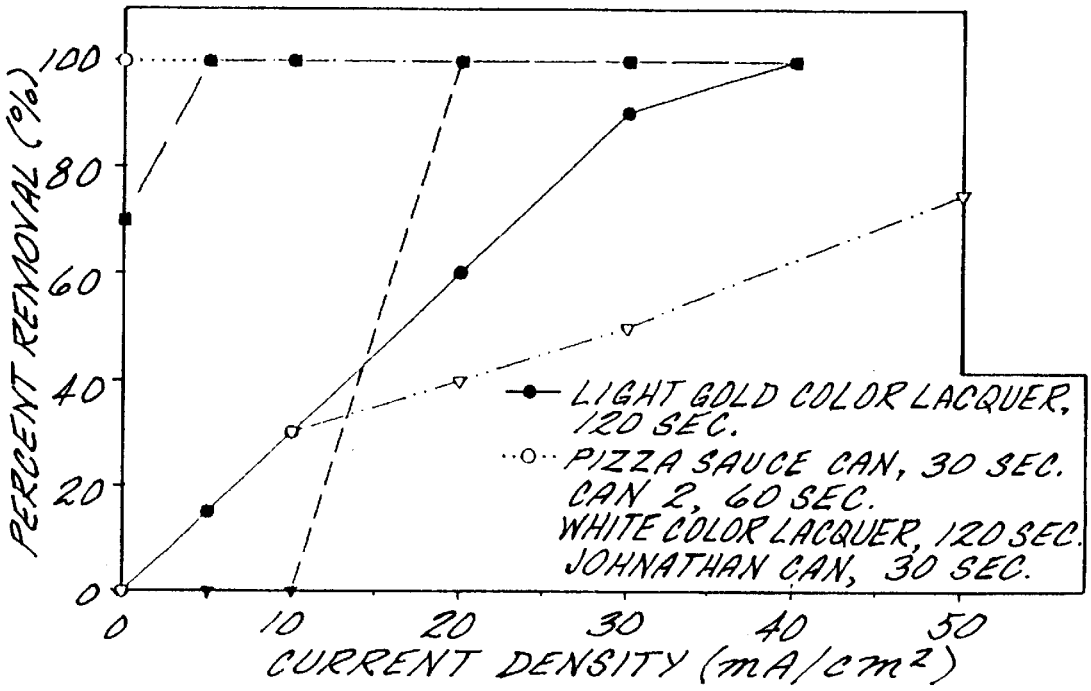
FIG. 25 illustrates the effect of current densities on lacquer removal at 87–88° C.
Figure 26:
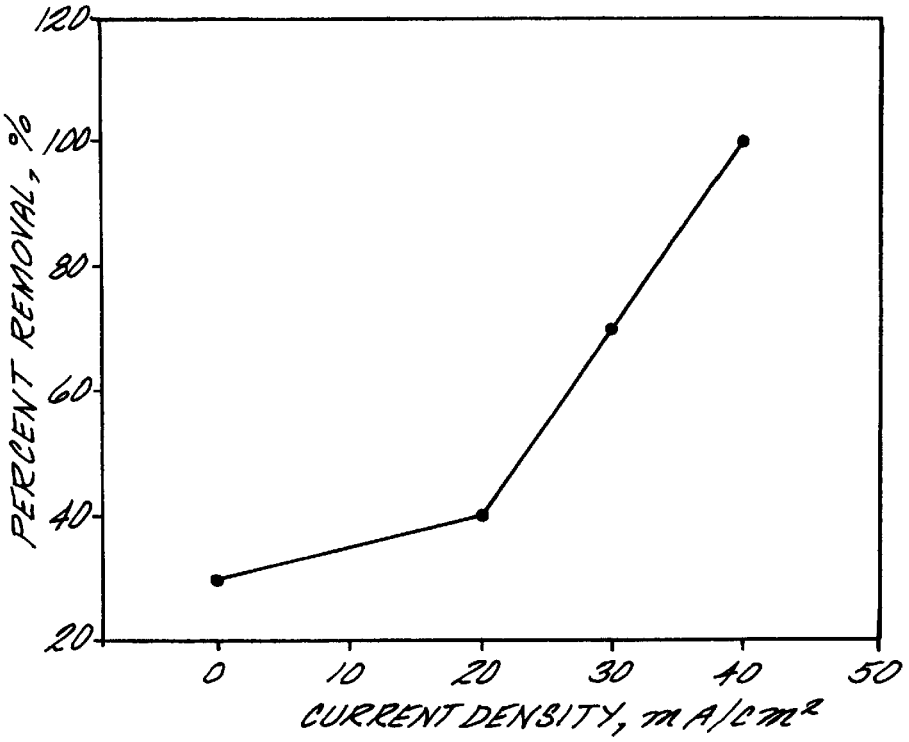
FIG. 26 illustrates the effect of current densities on lacquer removal for pizza sauce can using 18% SP-76 at 80° C. for 60 seconds.

FIGS. 25 and 26 show the effect of current density on lacquer removal. The experiments were performed in a beaker at 190° F. (88° C.) for residence times of 30 to 120 seconds with no applied stirring. At a temperature of 87–88° C., FIG. 25 shows that current density does not have an effect on removal of pizza can lacquer, because the lacquer is removed even without any current. At a lower temperature (80° C.), FIG. 26 shows that pizza can lacquer removal is a strong function of current density. For a Jonathan can, FIG. 25 shows that 70% of the lacquer can be removed in 1 minute without passing any current. When a current greater than 5 mA/cm$^2$ is applied the lacquer is completely removed. For can 2, some minimum current is required for the lacquer to be removed completely. But without applying current the lacquer does not come off. The white and light gold colored lacquers show current density dependence and the lacquer removal gradually increases with increasing current densities.

Example 17

Figure 27:
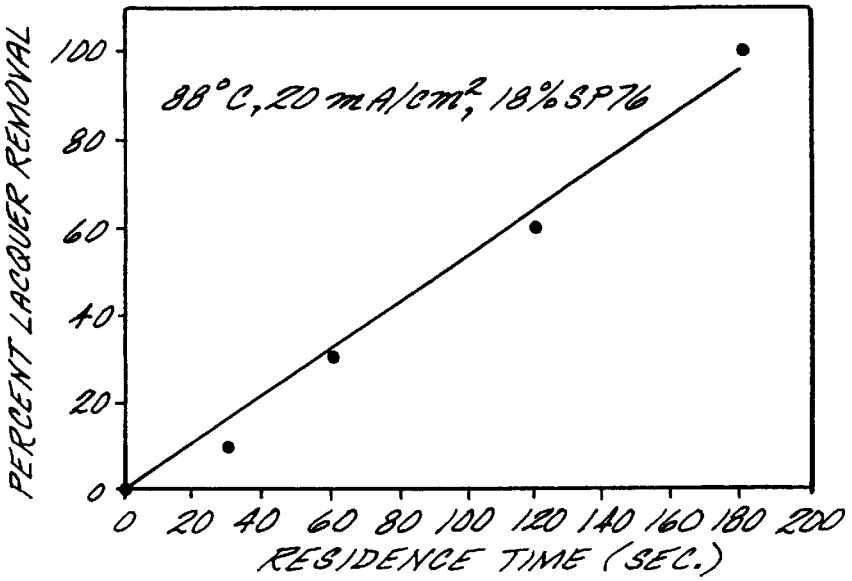
FIG. 27 illustrates the effect of residence time on lacquer removal for light gold lacquer cans.

A pilot delacquering facility was constructed in order to test the large-scale effectiveness of the disclosed process. To study the influence of current density on residence time several pilot scale delacquering studies were carried out using a small scale plating barrel system using 5 weight % sodium lauryl sulfate with 6 weight % sodium sulfate at 80° C. Lacquer removal is related to the total charge passed (product of current and the residence time), not the magnitude of the current density. The experiments indicate that lacquer removal is more efficient at lower current densities. While not being bound to theory, one reason for this observation could be related to the wetting time between the tin fragments and the surfactant/electrolyte solution. More time is required to pass the same amount of charge at lower current densities. As a result the fragments are in contact with the solution for longer periods of time. This may facilitate wetting at the lacquer metal interface creating more surface area for hydrogen evolution. FIG. 27 shows the effect of residence time on the percent lacquer removal for light gold color lacquered cans. This can is not easily wettable, and it can be seen that the longer time enables wetting and therefore complete removal of the lacquer. The results show that de-lacquering at low current density is marginally better probably due to increased wetting time available for the lacquer and also lower voltages result due to low current density used. Same results were observed for laboratory scale experiments. Effect of charge density on lacquer removal for light gold can is shown in FIG. 10. Experiments were carried out either at constant time or at constant current density. Lacquer removal for both experiments was consistent. Percent removal for light gold lacquer linearly increases with increasing charge density.

Example 18

A pilot detinning facility was constructed in order to test the large-scale effectiveness of the disclosed process. The pilot facility included a series of five 19-gallon (73 liters) polypropylene tanks. Tin cans slit as described above were washed in the first tank and then rinsed in the second tank. The third tank was used for lacquer removal, and the fourth tank for detinning. A final rinse step was performed in the fifth tank. The slit tin cans were transported through the system by a 6-inch diameter, 12 inch long polypropylene barrel equipped with dangler electrodes that may be made cathodic for lacquer removal and anodic for tin removal.

Preliminary experiments with individual 2 inch×2 inch coupons showed that some types of lacquers were more easily removed than other types using an electrolyte solution comprising 5% by weight sodium lauryl sulfate at current densities lower than 0.5 A/cm$^2$. All lacquers were removed within 25 seconds using a current density of 1.0 A/cm$^2$, but only three of six lacquers were removed within 25 seconds at a current density of 0.01 A/cm$^2$. Accordingly, a minimum current density of 0.10 A/cm$^2$ is recommended for the lacquer removal process. Preliminary experiments also showed that rates of lacquer removal are doubled at 180° F. compared to rates at 120° F. Using these conditions, when starting with an average tin coating of 0.326% by weight, the average detinning result was 0.096% tin by weight with a standard deviation of 0.056.

Example 19

Parameters for the pilot studies were selected from the results obtained in the electrochemical experiments of above Example 18. The barrel system experiments were carried out using two separate solutions, 1 weight % sodium lauryl sulfate with 0.5 M potassium nitrite as the supporting electrolyte and 5 weight % sodium lauryl sulfate with 6 weight % sodium sulfate as the supporting electrolyte. A wire mesh was inserted along the walls of the barrel. Table 16 shows the data for experiments run using 1 weight % sodium lauryl sulfate with 0.5 M potassium nitrite as the lacquer removal bath.

TABLE 16

| Run No. | Temperature (° F.) | Loading (lbs) | Current (A) | Voltage (V) | Rotation speed (rpm) | Residence Time (minutes) |
|---|---|---|---|---|---|---|
| 1 | 175 | 0.5 | 25 | 7 | 6 | 10 |
| 2 | 175 | 0.5 | 25 | 7 | 6 | 30 |
| 3* | 175 | 0.5 | 25 | 5 | 6 | 30 |
| 4* | 175 | 0.25 | 25 | 5 | 6 | 30 |
| 5* | 175 | 0.25 | 25 | 10 | 6 | 30 |

*Stainless steel mesh present in the plating barrel

These results indicate that the lacquer coatings could not be economically removed using this solution, in that residence times of 30 minutes resulted in minimal removal of the lacquer coatings.

Table 17 shows data for delacquering in a 5 weight % sodium lauryl sulfate solution with 6 weight % sodium sulfate at an applied current density was 0.05 A/cm$^2$, and a voltage difference between the anode and the cathode electrodes of between 12 and 16 volts.

TABLE 17

| Run No. | Temperature (° F.) | Loading (lbs) | Current (A) | Voltage (V) | Rotation speed (rpm) | Residence Time (minutes) |
|---|---|---|---|---|---|---|
| 1 | 160 | 0.5 | 60 | 12 | 6 | 2 |
| 2* | 160 | 0.5 | N/A | N/A | N/A | N/A |
| 3 | 175 | 0.25 | 50 | 12–16 | 6 | 2 |
| 4[γ] | 175 | 0.25 | 50 | 14 | 4 | 2 |
| 5[γλ] | 175 | 0.25 | 50 | 12–16 | N/A | 2 |
| 6[γλ] | 175 | 0.25 | 50 | 12–16 | N/A | 2 |
| 7[γ] | 175 | 0.25 | 60 | N/A | 5 | 2 |
| 8[γ] | 175 | 0.25 | 55 | N/A | 3 | 2 |

Figure 17:
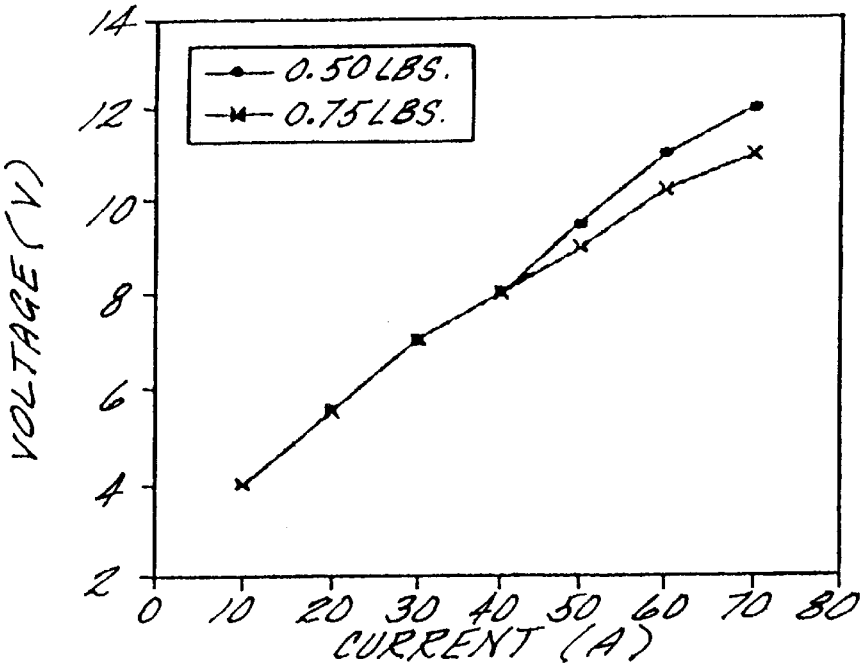
FIG. 17 illustrates the voltage-current relationship for the delacquering process for different ladings tin can pieces.
Figure 18:
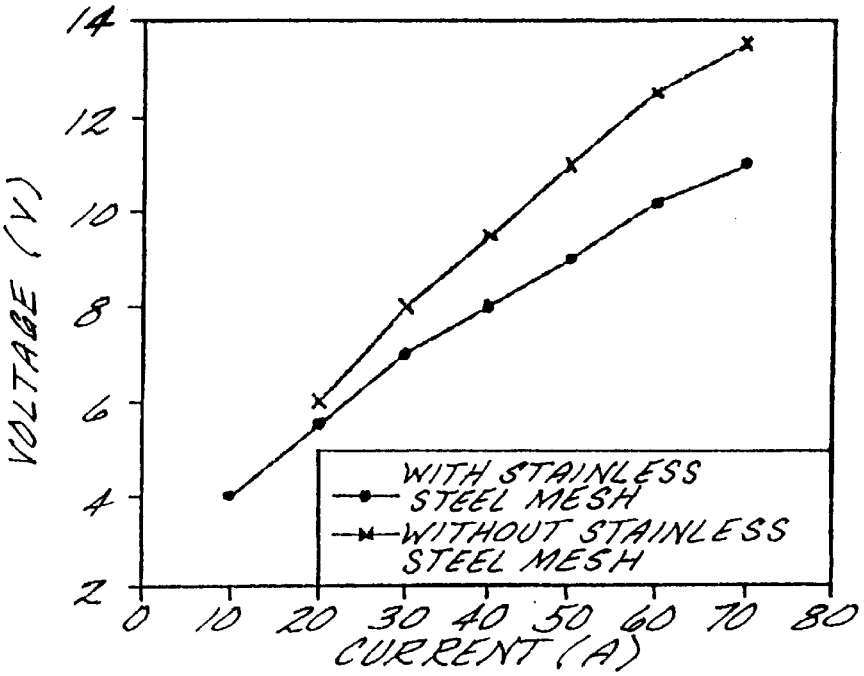
FIG. 18 illustrates the voltage-current relationship for the delacquering process with and without a stainless steel mesh.

*polarization measurements were carried out during run
[γ]cans were immersed in solution with no applied current for 2 minutes
[λ]cans were scratched prior to run Polarization studies were carried out in this solution and are presented in FIGS. 16 and 17. The voltage-current relationship is linear indicating that this process is ohmically controlled. The tin can loading and the barrel rotation speed have little influence on the voltage-current relationship. The introduction of a stainless steel mesh in the plating barrel did not improve the voltage-current characteristics for the delacquering process, FIG. 18. The steel mesh lowers the voltage but provides more surface for hydrogen evolution. As a result, the current density on the tin cans is reduced. Depending on the parameters used, the slope of the line varies between 0.12 and 0.15 ohms. The data and experimental conditions are listed in Table 18.

TABLE 18

| Run No. | Rotation Speed (rpm) | Stainless Steel Mesh | Loading (lbs) | Slope (ohms) |
|---|---|---|---|---|
| 1 | 0 | yes | 0.5 | 0.13 |
| 2 | 0 | yes | 0.75 | 0.12 |
| 3 | 0 | no | 0.75 | 0.15 |

Example 20

Figure 13:
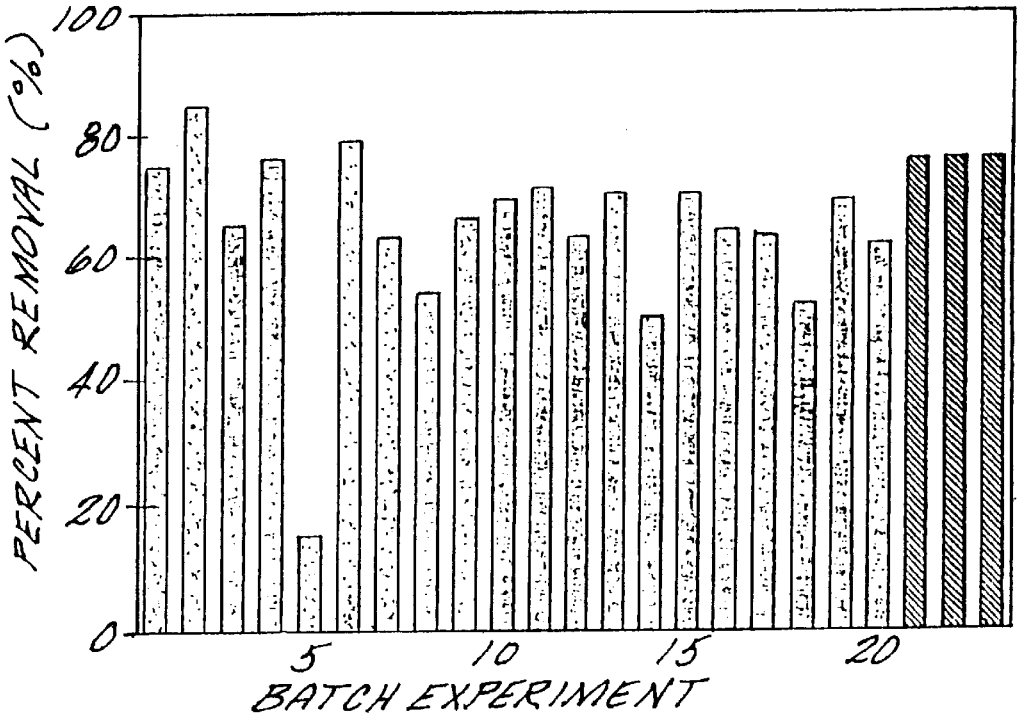
FIG. 13 illustrates the percent weight of lacquer removed for different runs in a plating barrel system with 6 weight % sodium sulfate at 80° C. The current density and residence times were 50 mA/cm$^2$ and 2 minutes for runs 1–20; 10 mA/cm$^2$ and 10 minutes for runs 21–23.

Because the dissolution of iron was observed when using stainless steel counter electrodes in previous reactor barrel (as well as electrochemical cell) delacquering studies, for subsequent studies the counter electrodes were replaced with DSA (Dimensionally Stable Anode) electrodes comprising a titanium sheet coated with ruthenium oxide. Reactor studies were carried out using 0.25 lbs of tin samples. Tin samples (0.25 lb) were delacquered using 5 weight % sodium lauryl sulfate and 6 weight % sodium sulfate in tap water. The bath temperature and the applied current density were 80° C. and 50 mA/cm$^2$, respectively. Based on previous studies indicating that most of the lacquer could be removed in approximately 80 seconds, a residence time of 120 seconds was used. FIG. 13 shows the percent removal of lacquer by weight for 20 batch experiments. The current density and residence time were 50 mA/cm$^2$ and 2 minutes for runs 1–20; 10 mA/cm$^2$ and 10 minutes for runs 21–23. The experimental runs that showed poor lacquer removal, batch numbers 5, 8 and 14, resulted from poor contact between the dangling electrodes and the tin coupons. This was confirmed by the high voltages measured during these experimental runs.

Example 21

The influence of current density on residence time for 1 lb of tin samples is shown in Table 20. The results indicate that lacquer removal is related to the total charge passed, not the magnitude of the current density. In fact, previous study indicates that lacquer removal is more efficient at lower current densities. Without being bound by theory, a plausible reason for this observation could be related to the wetting time between the tin coupons and the surfactant/electrolyte solution. More time is required to pass the same amount of charge at lower current densities. As a result, the tin coupons are in contact with the solution for longer periods of time. This may facilitate wetting at the lacquer metal interface, thereby creating more surface area for hydrogen evolution. Thus, cathodic disbonding of the lacquer coating is more efficient.

TABLE 20

| Current Density | Residence Time (minutes) | Temperature (° C.) |
|---|---|---|
| Delacquered at 50 mA/cm$^2$ | 8 | 25 |
| Delacquered at 50 mA/cm$^2$ | 2 | 80 |
| Delacquered at 10 mA/cm$^2$ | 8 | 25 |

After the delacquering step, the tin coupons turned gray and the solution contained a red precipitate. The gray color was attributed to the formation of a passive film of tin. Cyclic voltametric studies of tin passivation in caustic solutions showed similar color changes. The color change may also be due to local attack by hydroxyl groups formed during the cathodic reduction of water.

Figure 14:
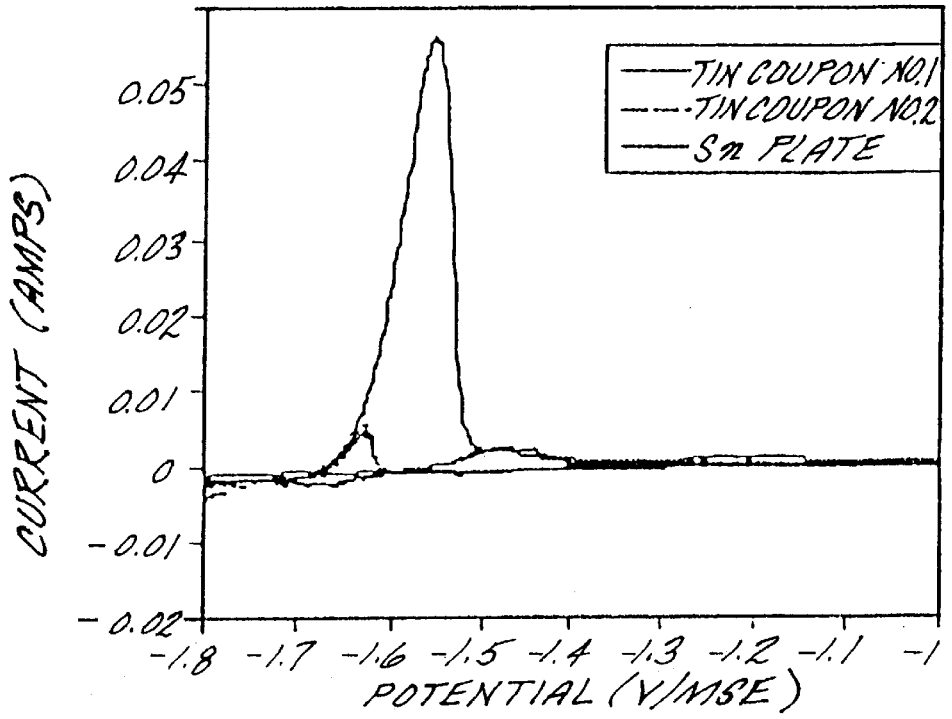
FIG. 14 illustrates the cyclic voltammetry of tin coupons after detinning in 3M KOH at 80° C.

After the lacquer was removed, the samples were rinsed in tap water and placed in a 3.0 M KOH detinning bath maintained at 80° C. under a constant potential of −1.2 V applied between the dangling electrodes and a mercurous sulfate reference electrode. Cyclic voltammetry was used to determine the efficiency of the tin removal step. FIG. 14 shows cyclic voltammograms for tin samples in 3.0 M KOH after the detinning step in the barrel reactor. Based on these measurements, samples from two separate runs showed no presence of tin.

Example 22

The samples and delacquering and detinning solutions from the reactor barrel experiments of Example 10 were analyzed prior to and after delacquering and detinning using several analytical techniques. Chemical Oxygen Demand (COD) and Atomic Absorption (AA) were used to characterize the waste solution and Inductive Coupled Plasmometry (ICP) was used to analyze the red precipitate formed during the delacquering process and the tin coupons before and after detinning. The results are tabulated in Tables 21 and 22.

TABLE 21

| Sample Treatment | Tin Content (μg/g) |
|---|---|
| Before detinning (delacquered at 50 mA/cm$^2$) | 2153 |
| After detinning (delacquered at 50 mA/cm$^2$, 25° C.) | 965 |
| After detinning (delacquered at 50 mA/cm$^2$, 80° C.) | 776 |
| After detinning (delacquered at 10 mA/cm$^2$, 25° C.) | 965 |

TABLE 22

| Sample Treatment | Chemical Oxygen Demand (mg/L) |
|---|---|
| Electrolyte before delacquering | 8,500 |
| Electrolyte after delacquering | 10,300 |
| Red precipitate after delacquering | 800,000 |

These results show that during the reactor experiments, more tin was removed at higher temperature. These results are in agreement with studies carried out on single tin coupons and tin plate. The results further indicate that some of the lacquer actually dissolves during the delacquer process. The high COD for the slurry, 800,000 mg/kg, suggests that the surfactant is unstable and forms insoluble species during the cathodic delacquering process. The red slurry also contained 56,333 $\mu$g/g of iron and 33,746 $\mu$g/g of tin. The results indicate that some metal dissolution occurs during the cathodic disbonding of the lacquer coating.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A process for electrochemically removing an outer polymeric coating and an inner tin coating adhered to a steel substrate, comprising:

providing a caustic aqueous electrolyte solution in an electrically conductive container;

immersing the polymeric and tin coated steel substrate in the electrolyte solution; and applying anodic current to the electrically conductive container from the positive terminal of a power source whose negative terminal is connected to a counter electrode immersed in the electrolyte solution, thereby establishing an electrolytic circuit wherein the electrically conductive container is the anode and the counter electrode is the cathode, thereby removing the polymeric coating and selectively removing the tin coatings from the steel substrate without appreciable dissolution of the steel substrate due to the steel substrate being made passive by selective control of anodic potential.

2. The process in accordance with claim 1, wherein:

the caustic aqueous electrolyte solution comprises a caustic in a concentration range from about 0.2 N to about 5.0 N so that the steel substrate is made passive.

3. The process in accordance with claim 1, wherein:

the anode is maintained at a potential between about −1.5 and −1.0 volts relative to an MSE reference so that the metal substrate is made passive and the tin coatings are selectively removed.

4. The process in accordance with claim 1, wherein:

the coated substrate is derived from tin cans, tin can trimmings, tin can scrap, or a combination thereof.

5. A process for electrochemically removing an outer polymeric coating and an inner tin coating adhered to a steel substrate, comprising:

providing a first aqueous electrolyte solution in a first electrically conductive container and a second caustic aqueous electrolyte solution in a second electrically conductive container;

immersing the polymeric and tin coated steel substrate in the first electrolyte solution;

treating the coated steel substrate by applying cathodic current to the first electrically conductive container from the negative terminal of a first power source whose positive terminal is connected to a counter electrode immersed in the first electrolyte solution thereby establishing a circuit wherein the first electrically conductive container is the cathode and the counter electrode is the anode, thereby removing the polymeric coating from the steel substrate;

transferring the treated substrate to the second electrically conductive container; and applying anodic current to the second electrically conductive container from the positive terminal of a second power source whose negative terminal is connected to a counter electrode immersed in the second electrolyte solution thereby establishing a circuit wherein the second electrically conductive container is the anode and the counter electrode is the cathode, thereby removing the tin coating from the treated substrate.

6. The process in accordance with claim 5, wherein:

the first electrolyte solution comprises at least one electrolyte selected from the group comprising mineral acids, detergents, inorganic salts, or a combination thereof.

7. The process in accordance with claim 6, wherein:

the electrolyte is selected so as to prevent appreciable dissolution of tin or the metal substrate.

8. The process in accordance with claim 6, wherein:

the first electrolyte solution comprises an alkali mixture of solid sodium hydroxide.

9. The process in accordance with claim 6, wherein:

the first electrolyte solution comprises sodium lauryl sulfate in amount of about 5 weight % and sodium sulfate in an amount of about 6 weight %.

10. The process in accordance with claim 6, wherein:

the pH of the first electrolyte solution is in the range from about 0 to about 15.

11. The process in accordance with claim 5, wherein:

the polymer coating is removed in a time period of between about 30 seconds to about 300 seconds by application of a cathodic current.

12. The process in accordance with claim 5, wherein:

the cathodic current is between about 0.05 and 0.25 $A/cm^2$.

13. The process in accordance with claim 5, wherein:

the coated steel substrate and the first electrically conductive container are cathodically protected thereby preventing any substantial metal dissolution in the first electrolyte solution.

14. The process in accordance with claim 5, wherein:

the second electrolyte solution comprises at least one electrolyte selected from the group comprising caustics.

15. The process in accordance with claim 14, wherein:

the electrolyte is potassium hydroxide in an amount from about 0.25 to 5.0 N.

16. The process in accordance with claim 5, wherein:

the anodic voltage is in the range from about −1.5 V to −1.0 V relative to an MSE reference, and the cathodic voltage is in the range from about −2.15 V to −2.35 V relative to an MSE reference electrode.

17. The process in accordance with claim 5, wherein:

the tin coating is removed in a time period of between about 40 seconds to about 210 seconds by application of an anodic current.

18. The process in accordance with claim 5, wherein:

the coated steel substrate is slit.

19. The process in accordance with claim 5, wherein:

the coated steel substrate is washed in a detergent solution before being submersed in the first electrolyte bath.

20. A process for electrochemically delacquering and detinning a tin can substrate comprising:

providing a first aqueous electrolyte solution in a first electrically conductive container and a second caustic aqueous electrolyte solution in a second electrically conductive container;

immersing the tin can in the first electrolyte solution;

treating the tin can by removing the lacquer coating by application of a cathodic current to the first electrically conductive container from the negative terminal of a first power source whose positive terminal is connected to a counter electrode immersed in the first electrolyte solution thereby establishing a circuit wherein the first electrically conductive container is the cathode and the counter electrode is the anode, thereby removing the lacquer coating from the tin can;

transferring the treated tin can to the second electrically conductive container; and removing the tin coating by application of an anodic current to the second electrically conductive container from the positive terminal of a second power source whose negative terminal is connected to a counter electrode immersed in the second electrolyte solution thereby establishing a circuit wherein the second electrically conductive container is the anode and the counter electrode is the cathode, thereby removing the tin coating from the treated tin can.

21. The process in accordance with claim 20, wherein:

the first electrolyte solution comprises at least one electrolyte selected from the group comprising mineral acids, bases, detergents or a combination thereof.

22. The process in accordance with claim 21, wherein:

the electrolyte is selected so as to prevent appreciable dissolution of any of the metal part of the substrate.

23. The process in accordance with claim 21, wherein the first electrolyte solution comprises an alkali mixture of solid sodium hydroxide.

24. The process in accordance with claim 21, wherein the first electrolyte solution comprises sodium lauryl sulfate in amount of about 5 weight % and sodium sulfate in an amount of about 6 weight %.

25. The process in accordance with claim 21, wherein:

the pH of the first electrolyte solution is in the range from about 0 to about 15.

26. The process in accordance with claim 20, wherein:

the lacquer coating is removed in a time period of between about 30 seconds to about 300 seconds by application of a cathodic current.

27. The process in accordance with claim 20, wherein:

the cathodic current is about 0.05 to 0.25 A/cm$^2$.

28. The process in accordance with claim 20, wherein:

the second electrolyte solution comprises at least one electrolyte selected from the group comprising caustics.

29. The process in accordance with claim 28, wherein:

the electrolyte is potassium hydroxide in an amount from about 1.0 to 3.0 N.

30. The process in accordance with claim 20, wherein:

the anodic voltage is in the range from about −1.5 V to −1.0 V relative to an MSE reference, and the cathodic voltage is in the range from about −2.15 V to −2.35 V relative to an MSE reference electrode.

31. The process in accordance with claim 20, wherein:

the tin coating is removed in a time period of between about 40 seconds to about 210 seconds by application of an anodic current.

32. The process in accordance with claim 20, wherein:

the tin can substrate is slit.

33. The process in accordance with claim 20, wherein:

the coated tin can substrate is washed in a detergent solution before being submersed in the first electrolyte solution.

34. The process in accordance with claim 20, wherein:

the tin can substrate is washed in the first electrolyte solution.

35. The process in accordance with claim 20, wherein:

the first electrolyte solution is maintained at a temperature in the range from about 130° F. to about 200° F.

36. The process in accordance with claim 20, wherein:

the second electrolyte solution is maintained at a temperature in the range from about 130° F. to about 200° F.

37. A process for electrochemically delacquering a lacquered tin can substrate, comprising:

providing an aqueous electrolyte solution within an electrically conductive container, the electrolyte solution comprising at least one electrolyte selected from the group comprising mineral acids, detergents, the pH of the electrolyte solution being between about 0 and 15;

immersing the tin can substrate into the electrolyte solution; and applying cathodic current to the electrically conductive container, thereby delacquering the tin can substrate without appreciable dissolution of tin or other metal by cathodically protecting the tin can substrate and the electrically conductive container.

38. A process for electrochemically delacquering a lacquered tin can substrate, comprising:

providing a conductive aqueous electrolyte solution within an electrically conductive container, the pH of the electrolyte solution being between about 0 and 15;

immersing the tin can substrate into the electrolyte solution; and applying cathodic current to the electrically conductive container, thereby delacquering the tin can substrate in less than about 25 seconds without appreciable dissolution of tin or other metal, wherein the tin can substrate and the electrically conductive container are cathodically protected.

39. An apparatus for electrochemically removing an outer polymeric coating and an inner tin coating from a steel substrate, comprising:

a first electrically conductive container having a first electrolyte solution therein, the first electrically conductive container being receptive to a cathodic current for removal of the polymeric coating;

a second electrically conductive container having a second electrolyte solution therein, the second electrically conductive container being receptive to an anodic current for removal of the tin coating from the steel substrate; and a conveyor for delivering the steel substrate from the first tank to the second tank.

40. The apparatus of claim 39, wherein:

the first electrolyte solution comprises at least one electrolyte selected from the group comprising mineral acids, bases, detergents or a combination thereof.

41. The apparatus of claim 39, wherein:

the pH of the first electrolyte solution is in the range from about 0 to about 15.

42. The apparatus of claim 39, wherein:

the cathodic current is about 0.05 to 0.25 $A/cm^2$.

43. The apparatus of claim 39, wherein:

the second electrolyte solution comprises at least one electrolyte selected from the group comprising caustics.

44. The apparatus of claim 43, wherein:

the electrolyte is potassium hydroxide in an amount from about 1.0 to 5.0 N.

45. The apparatus of claim 39, wherein:

the conveyor comprises a conveyor belt with at least one magnet fastened to the conveyor belt.

46. The apparatus of claim 39, further comprising:

a preliminary wash tank having a washing solution therein, and a conveyor for delivering the steel substrate from the preliminary wash tank to the first electrically conductive container.

47. The apparatus of claim 39, further comprising:

a final rinse tank having a rinse solution therein, and a conveyor for delivering the steel substrate from the second electrically conductive container to the final rinse tank.

48. The apparatus of claim 39, further comprising:

a first foraminous cylinder rotatably mounted, a first central cylinder mounted longitudinally within the first foraminous cylinder having a first and a second end, wherein at least one end of the first central cylinder extends beyond the first foraminous cylinder and is fastened to a rotator to effect rotation of the first central cylinder, wherein the first foraminous cylinder is partially submerged in the first electrically conductive container whereby the first electrolyte solution communicates through the first foraminous cylinder, a first conveyor to advance the steel substrate through the first foraminous cylinder;

a second conveyor to transfer the steel substrate from the first foraminous cylinder to a second foraminous cylinder;

the second foraminous cylinder rotatably mounted, a second central cylinder mounted longitudinally within the second foraminous cylinder having a first and a second end, wherein at least one end of the second central cylinder extends beyond the second foraminous cylinder and is fastened to a rotator to effect rotation of the second central cylinder, wherein the second foraminous cylinder is partially submerged in the second electrically conductive container whereby the second electrolyte solution communicates through the second foraminous cylinder;

a third conveyor to advance the steel substrate through the second foraminous cylinder; and a fourth conveyor to transfer the steel substrate from the second electrically conductive container.

49. The apparatus of claim 48, wherein:

the first and third conveyors comprise a plurality of helical members interposed between the foraminous cylinder and the central cylinder, the helical members being arranged to advance the steel substrate through the foraminous cylinder.

50. The apparatus of claim 39, further comprising:

a first and second bus bar disposed within the first and second electrically conductive containers respectively, a plurality of dangler electrodes suspended from the first and second bus bar, wherein the first bus bar is anodically connected to a power source and the second bus bar is cathodically connected to a power source, wherein the plurality of dangler electrodes suspended from the first bus bar are anodes and the plurality of dangler electrodes suspended from the second bus bar are cathodes.

51. The apparatus of claim 39, wherein:

the first electrically conductive container comprises a perforated internal helix drum rotatably mounted to a first electrolyte bath container, the first electrolyte solution being disposed with the first electrolyte bath container, the second electrically conductive container comprises a perforated internal helix drum rotatably mounted to a second electrolyte bath container, the second electrolyte solution being disposed with the second electrolyte bath container.

52. An apparatus for electrochemically removing an outer polymeric coating and an inner tin coating from a steel substrate, comprising:

a first electrically conductive container having a first electrolyte solution therein, the first electrically conductive container being receptive to a cathodic current for removal of the polymeric coating; the first electrically conductive container having an internal helix for advancing the steel substrate through the first electrically conductive container, the first electrically conductive container having a first and a second end, wherein at least one end of the first electrically conductive container is fastened to a rotator to effect rotation of the first electrically conductive container;

a second electrically conductive container having a second electrolyte solution therein, the second electrically conductive container being receptive to an anodic current for removal of the tin coating from the steel substrate, the second electrically conductive container having an internal helix for advancing the steel substrate through the second electrically conductive container, the second electrically conductive container having a first and a second end, wherein at least one end of the second electrically conductive container is fastened to a rotator to effect rotation of the second electrically conductive container; and a conveyor for delivering the steel substrate from the first electrically conductive container to the second electrically conductive container.

53. The apparatus of claim 52, wherein:

the internal helix comprises a plurality of helical members, the helical members being arranged to advance the steel substrate through the first and second electrically conductive containers.

54. The apparatus of claim 53, further comprising:

a first axial bus bar disposed within the first electrically conductive container, the first bus bar being electrically connected to an anode and a second axial bus bar disposed within the second electrically conductive container, the second axial bus bar being electrically connected to a cathode.

55. The apparatus of claim 54, further comprising:

dangler electrodes coupled to the first and second bus bars.

56. The apparatus of claim 55, wherein:

the dangler electrodes comprise expanded mesh dimensionally stable anodes coupled to the first bus bar and expanded mesh stainless steel cathodes coupled to the second bus bar.

57. The apparatus of claim 52, wherein:

the first electrically conductive container is perforated and disposed within a first electrolyte bath container and the second electrically conductive container is perforated and disposed within a second electrolyte bath container.

58. The apparatus of claim 52, wherein:

the second electrically conductive container is perforated and disposed within an electrolyte bath container.

* * * * *